US006145956A

United States Patent [19]

Koitabashi et al.

[11] Patent Number: 6,145,956

[45] **Date of Patent: *Nov. 14, 2000**

[54] DISCHARGE RECOVERY METHOD AND APPARATUS FOR AN INK JET RECORDING HEAD

[75] Inventors: Norifumi Koitabashi; Hitoshi Sugimoto; Hiroshi Tajika; Miyuki Matsubara, all of Yokohama; Atsushi Arai, Kasukabe, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/145,050

[22] Filed: Nov. 3, 1993

Related U.S. Application Data

[63] Continuation-in-part of application No. 07/683,786, Apr. 11, 1991, abandoned.

[30] Foreign Application Priority Data

Apr. 11, 1990 [JP] Japan ..... 2-95406

[51] Int. Cl.[7] ..... B41J 2/165

[52] U.S. Cl. ..... 347/30; 347/23

[58] Field of Search ..... 347/30, 29, 33, 347/23

[56] References Cited

U.S. PATENT DOCUMENTS

| | | | |
|---|---|---|---|
| 4,123,761 | 10/1978 | Kimura et al. | 347/30 |
| 4,272,772 | 6/1981 | Geil | 347/30 |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,567,494 | 1/1986 | Taylor | 346/140 R |
| 4,600,931 | 7/1986 | Terasawa . | |
| 4,692,777 | 9/1987 | Hasumi | 346/140 R |
| 4,712,172 | 12/1987 | Kiyohara et al. | 346/1.1 |
| 4,723,129 | 2/1988 | Endo et al. . | |
| 4,740,796 | 4/1988 | Endo et al. . | |
| 4,800,403 | 1/1989 | Accattino et al. . | |
| 4,853,717 | 8/1989 | Harmon et al. . | |
| 4,967,204 | 10/1990 | Terasawa et al. . | |
| 4,967,207 | 10/1990 | Ruder | 347/87 |
| 5,298,923 | 3/1994 | Tokunaga et al. | 347/30 |
| 5,379,061 | 1/1995 | Yamaguchi et al. | 347/23 |

FOREIGN PATENT DOCUMENTS

| | | | |
|---|---|---|---|
| 3633239 | of 0000 | European Pat. Off. . | |
| 88/08370 | 11/1988 | Germany | 347/33 |
| 84123670 | of 0000 | Japan . | |
| 84138461 | of 0000 | Japan . | |
| 145038 | 6/1988 | Japan | 347/30 |
| 63-130348 | 6/1988 | Japan | B41J 3/04 |
| 202453 | 8/1989 | Japan | 347/33 |
| 18055 | 1/1990 | Japan | 347/33 |
| 2169855 | of 0000 | United Kingdom . | |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A recovery method for recovering proper operation of an ink jet recording head having a plurality of discharge ports and a plurality of thermal energy generating elements each corresponding to each of the discharge ports includes providing a recovery device for performing recovery according to a first recovery mode for only applying pressure to the discharge ports to effect suction of ink from the discharge ports while the discharge ports are capped by a capping device, and a second recovery mode for concurrently applying pressure to the discharge ports and driving the thermal energy generating elements to forcibly exhaust ink from the discharge ports while the discharge ports are capped by the capping means. The method also includes selectively performing recovery according to one of the first recovery mode and the second recovery mode.

32 Claims, 20 Drawing Sheets

DISCHARGE RECOVERY METHOD AND APPARATUS FOR AN INK JET RECORDING HEAD

This application is a continuation of application Ser. No. 07/683,786 filed Apr. 11, 1991, now abandoned.

BACKGROUND OF THE INVENTION

1. Field of the Invention

This invention relates to a recovery method for an ink jet recording head and a recording head or an integral ink tank type recording head applicable to a printer, a copying apparatus, a facsimile apparatus, an ink jet recording apparatus or the like generally used as a business machine, and to a recording apparatus using a recording head removably mountable on the apparatus body.

2. Description of the Prior Art

In the conventional ink jet recording head and apparatus, a heat energy recording system utilizing film boiling provides better results than a system utilizing a piezo-electric element, and has been put into practice as an excellent system as compared to other heat energy recording systems such as light energy.

In order to eliminate any inconveniences attributable to the use of liquid ink as a recording agent, an ink jet recording apparatus provides a construction not evident in other recording apparatuses, i.e., means for refreshing the interior of liquid paths or restoring the discharge port forming surface into good condition, for example, a discharge recovery system for a recording head.

There are discharge recovery systems of various constructions. One system that refreshes the interior of liquid paths drives a discharge energy generating element when not recording to cause a predetermined ink receiving medium to effect ink discharge (called also preliminary discharge or idle discharge).

British Patent No. 2,169,855, discloses the above-described technique as well as the means to heat ink preliminarily and then effect preliminary discharge.

There is also a system which causes predetermined pressure to act on liquid paths, by pressurizing an ink supply system or effecting suction from ink discharge ports, to thereby force ink to be discharged from the discharge ports.

A typical patent which discloses this system is U.S. Pat. No. 4,600,931. This suction recovery is not effected at all times, but is effected immediately before a situation in which unsatisfactory recording occurs or in a non-discharge condition. There have been numerous patent applications filed for the invention of suction recovery, and above all, there is an invention which provides great recovery for making suction conditions great and normal recovery for effecting ordinary suction.

There is also a system for refreshing the discharge port forming surface and preventing the deflection of the discharge direction, in which a provision is made for a wiping member to form contact with the discharge port forming surface, and the two are moved relative to each other to thereby wipe off ink droplets, dust or the like adhering to and near the discharge ports.

DESCRIPTION OF THE RELATED PRIOR ART

Prior-art recovery means have disclosed that it is effective to vary preliminary discharge conditions in environmental changes during recording (including the temperature of a head, the ambient temperature, the steps in the sequence, etc.) and forced discharge by suction or a pressure pump are also usually effective, but there is the following problem.

In some cases, it has been impossible to attain high-level recovery from the loss of more ink, even over long periods of time. This has particularly posed a problem during forced discharge by suction or pressing, and a suction force or a pressing force has not uniformly acted from all of a plurality of discharge ports, thus wasting the ink. It has been found that even if the pump is made large in an effort to strengthen this recovery force, it is not so effective, but rather the amount of ink loss increases.

Also, an increased amount of ink discharged from each discharge port by preliminary discharge leads to a longer recovery process and accordingly to a reduced throughput of recording. These are noticeable in the recovery process under low temperature environment.

SUMMARY OF THE INVENTION

It is an object of the present invention to provide a recovery method and apparatus for an ink jet recording head which can efficiently improve the given recovering ability of forcible recovery means and can achieve reliable recovery without making an apparatus bulky.

It is another object of the present invention to provide a recovery method and a recording apparatus which can execute a reliable recovery process in spite of the presence and influence of an absorbing member which is a negative pressure generation source in an ink containing portion for ink supplied to a recording head.

It is still another object of the present invention to provide a recovery method and a recording apparatus which provides excellent results in the degree of recovery as compared to the prior art, shorten the processing time and optimally decrease the amount of ink loss.

More specifically, it is a further object of the present invention to provide a recovery method and a recording apparatus which can achieve efficient suction from the start of the recovery process without making a mechanism such as a tube pump bulky.

The present invention provides a recovery processing method for carrying out a recovery process on an ink jet recording head provided with discharge energy generating elements corresponding to a plurality of discharge ports, including:

a recovery mode for effecting at a time the element driving step of driving said discharge energy generating elements to discharge ink from said plurality of discharge ports and the step of forcibly discharging the ink from the interior of the head through said discharge ports.

The present invention provides a recovery processing method of carrying out a recovery process on an ink jet recording head provided with discharge energy generating elements corresponding to a plurality of discharge ports, including:

the heating step of heating ink in said recording head in response to the start of recovery; and a recovery mode for effecting at a time after said heating step the element driving step of driving said discharge energy generating elements to discharge the ink from said plurality of discharge ports and the step of forcibly discharging the ink from the interior of the head through said discharge ports.

The present invention provides a recording apparatus for effecting recording with an ink jet recording head carried thereon, said head integrally having an ink containing portion provided with an ink absorbing member therein, said apparatus having:

a recording mode for driving a plurality of discharge energy generating elements provided in said recording head in conformity with a recording signal to effect recording on a recording medium;

a recovery mode for effecting suction from the discharge ports of said recording head substantially simultaneously with the driving of said plurality of discharge energy generating elements provided in said recording head; and a mechanism for selecting said recording mode and said recovery mode.

The present invention is more effective particularly in heat generating elements as the discharge energy generating elements, and in an electro-thermal conversion member for forming a bubble, and preferably provides a recording apparatus as described above, wherein said recovery mode starts said suction during the growth of said bubble and effects a timing drive for causing the maximum suction force during said suction to act during the collapse of said bubble, and further provides as an optimum construction a recording apparatus as described above, wherein the driving frequency of said discharge energy generating elements in said discharge recovery process is set to a value higher than the limit refill frequency of the ink.

The present invention provides superior results than the prior art, can increase the throughput of ink jet recording and greatly extend the interval between the recovery processes.

Other objects or detailed constructions of the present invention will become apparent from the following detailed description of some embodiments of the invention.

DESCRIPTION OF THE PREFERRED EMBODIMENTS

The present invention will hereinafter be described in detail with reference to the drawings.

(1) Cartridge

Figure 1:
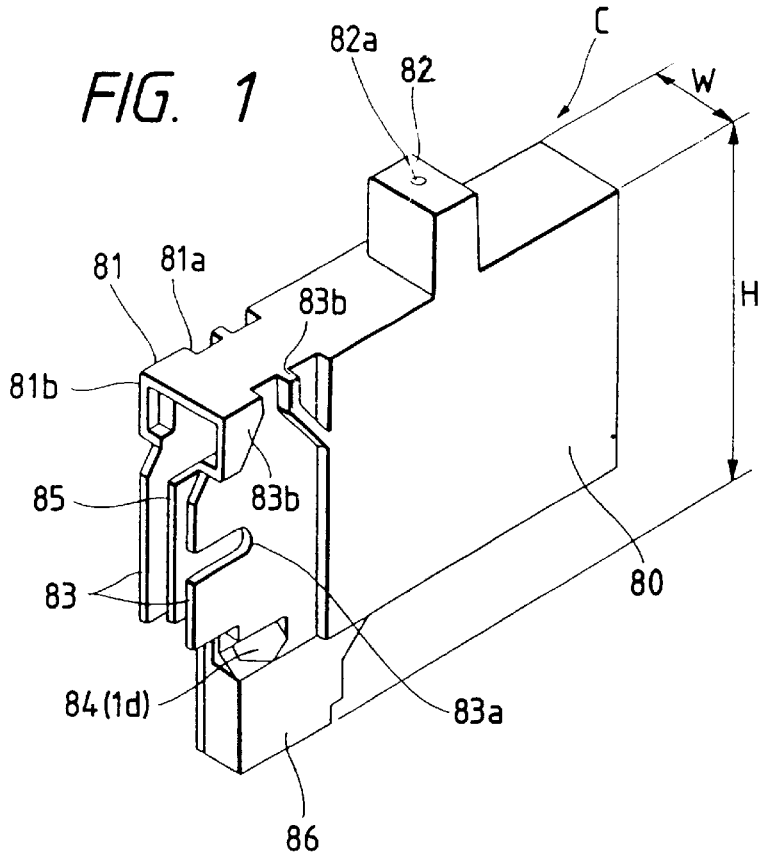
FIG. 1 is a representative view of a unitary recording head-ink tank type cartridge used in an embodiment of the present invention.

FIG. 1 shows an example of the construction of a cartridge C which can be carried on the carriage (which will be described later with reference to FIG. 3) of an ink jet recording apparatus according to an embodiment of the present invention. Above cartridge C, according to the present embodiment, is an ink tank portion 80 having an ink absorbing member (sponge) therein and has below it, a recording head 86, and further, a head side connector 85 for receiving a signal or the like for driving the recording head 86 and effecting the output of the detection of the amount of remaining ink is provided in a juxtaposed relationship with the ink tank portion 80. Accordingly, when this cartridge C is loaded onto the carriage to be described, the height H thereof can be minimized. Also, by making the thickness W of the cartridge in the scanning direction small, it is possible to minimize the size of the carriage to effectuate disposal of cartridge C as will be described later with reference to FIG. 2.

The reference numeral 83 designates a connector cover formed integrally with the outer wall of the tank to prevent inadvertent contact with the connector 85. The reference numeral 81 denotes a positioning portion formed with dash surfaces 81*a* and 81*b* in two directions. By providing a sufficient distance between these positioning surfaces and a positioning dash surface provided on the recording head 86, the reliable fixed positioning of the recording head becomes possible by pressing against an inclined surface 84 by a push pin which will be described later. The reference numeral 82 designates a knob for use when the cartridge C is to be mounted or dismounted with respect to a loading portion. The reference character 82*a* denotes an atmosphere communication hole formed in the knob 82 to communicate the interior of the ink tank portion 80 with the atmosphere. The reference character 82*a* designates a cut-away portion, the reference character 83*b* denotes a guide. Both act as a guide when loading the cartridge C onto the loading C portion.

The recording head 86 according to the present embodiment has a plurality of discharge ports opening into the bottom surface side as viewed in FIG. 1, and the discharge energy generating elements generating energy available for ink discharge are disposed in a liquid path portion communicating with the discharge ports. These discharge energy generating elements may be heat energy generating elements because the high integration of the discharge ports or liquid paths is possible.

Figure 2A:
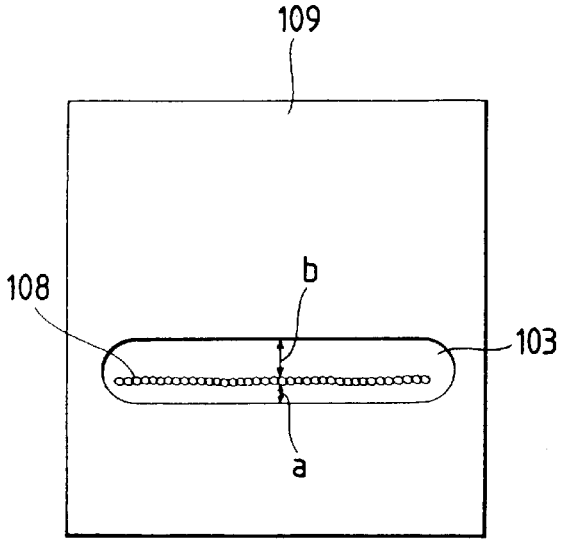
FIGS. 2A and 2B are a front view and a side cross-sectional view, respectively, showing an example of the construction of the recording head.
Figure 2B:
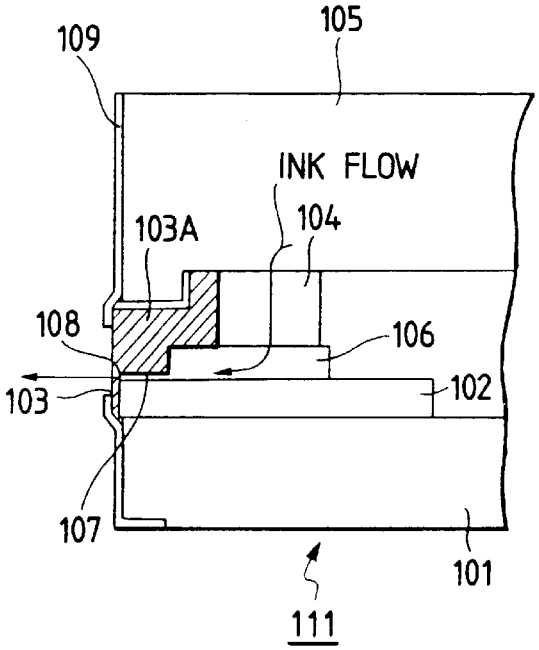

FIGS. 2A and 2B are a front view and a side sectional view, respectively, of the recording head 86 as it is seen from ahead in the discharge direction.

In FIGS. 2A and 2B, the reference numeral 101 designates the base plate of the recording head 86 which is formed of aluminum. A substrate (heater board) 102 formed of Si or the like, is adhesively secured onto the base plate 101. On the surface of the heater board 102, an electro-thermal conversion member (not shown) is formed as a heat energy generating element and a diode or the like as a functional element for driving this electro-thermal conversion member. The reference numeral 103 denotes an orifice plate (discharge port forming member) which is formed integrally with a top plate 103A formed with a groove for forming an ink liquid chamber.

The formation of discharge ports in this orifice port 103 can be accurately accomplished, for example, by the application of an excimer laser beam or the photoetching process, whereby a highly accurate shape can be obtained over a plurality of discharge ports. This orifice plate 103 is also used to prevent the deflection of the discharge direction which occurs due to the difference in wettability between a plurality of different materials when these materials are exposed on the discharge port forming surface.

The reference numeral 104 designates a filter provided in an ink supply port leading from a chip tank 105 to a common liquid chamber 106. The filter 104 removes the impurities of the ink and dust flowing as indicated by an arrow in the figure. The ink which has passed through the filter 104 flows into the common liquid chamber 106, and is supplied to each of a plurality of liquid paths 107 communicating with this liquid chamber, in conformity with the discharge of the ink. The reference numeral 109 denotes a keep member for holding down the orifice plate 103 by its resilient force or the like and bringing it into contact with the surface of openings (particularly the end surface of the heater board 102). In the present embodiment, SUS (stainless steel) is used as the keep member 109.

In the above-described construction, ink is supplied from the ink tank portion 80 made integral with the recording head 86 to the chip tank 105, whereafter the ink flows as indicated by the arrow. The ink first passes through the filter 104, whereby dust and impurities in the ink are removed, and the ink passes to the common liquid chamber 106 and directed therefrom to the liquid paths 107. The electro-thermal conversion members disposed in the liquid paths 107 are driven to thereby create a bubble in the ink, and by a change in the state of this bubble, the ink is discharged through the discharge ports 108.

(2) Carriage

Figure 3:
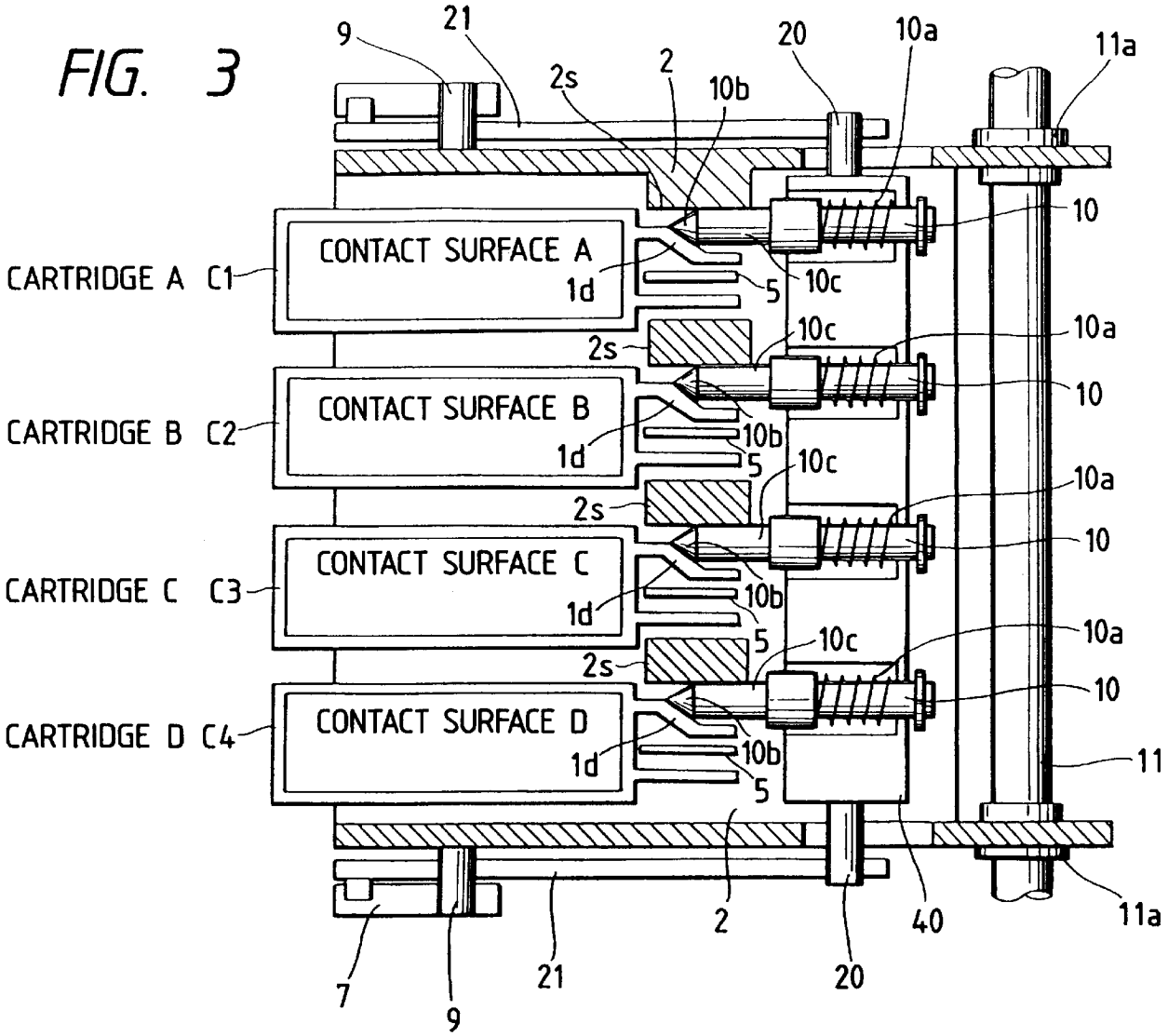
FIGS. 3 and 4 are a perspective view and a plan view, respectively, showing the surroundings of the carriage of the apparatus of the present embodiment in which the cartridge shown in FIG. 1 is mounted.
Figure 4:
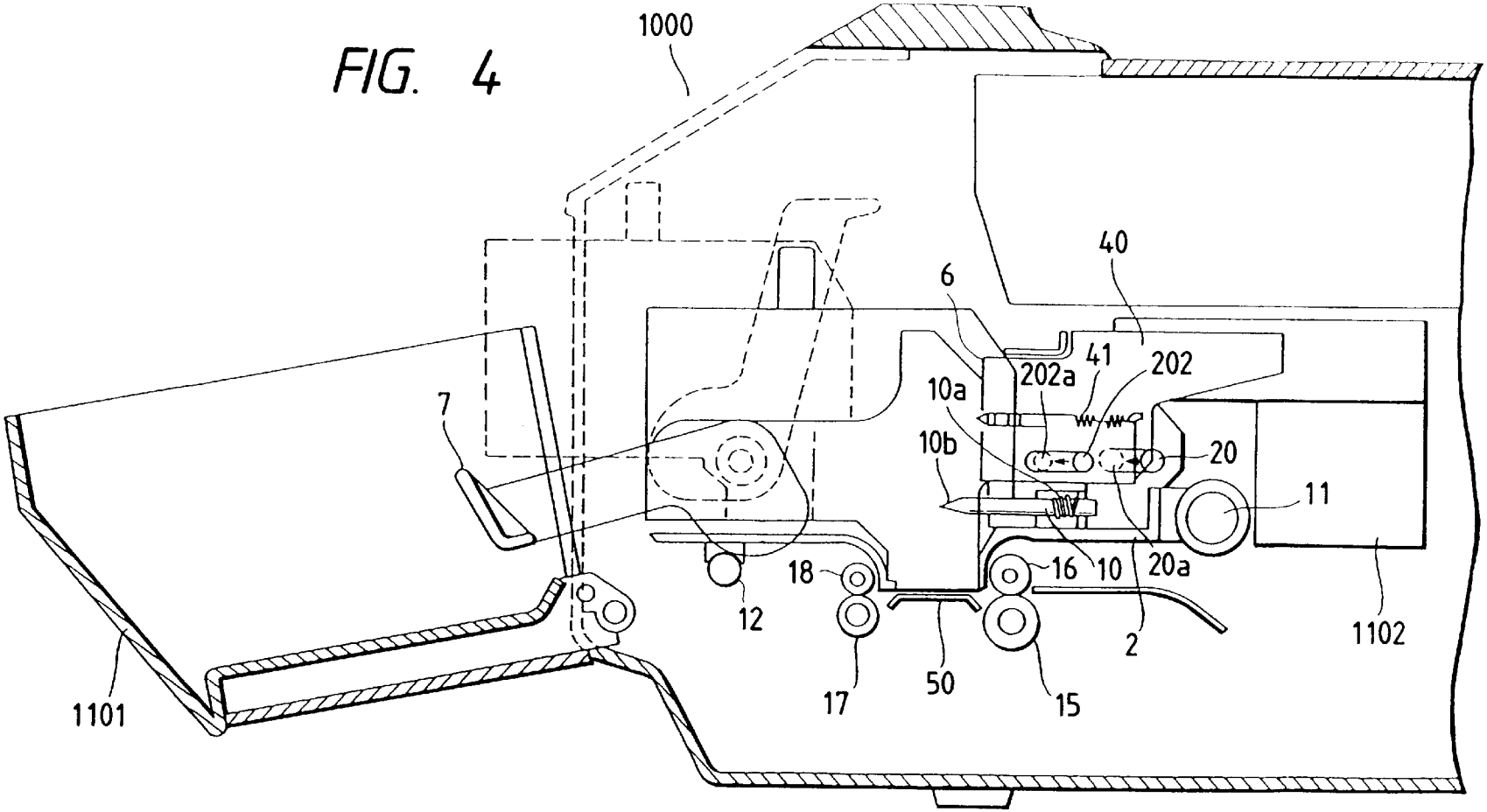

FIGS. 3 and 4 are a perspective view and a plan view, respectively, showing an example of the construction of the carriage surroundings in the ink jet recording apparatus on which the cartridge C shown in FIG. 1 is mountable. In these figures, four cartridges C1, C2, C3 and C4 (containing therein inks of different colors, for example, yellow, magenta, cyan and black) are positioned and loaded on the carriage 2.

Four push pins 10 (push pins A–D) are engaged with a connector holder 40 as a holding member, and are biased to the left by springs 10*a* (springs A–D) as viewed in FIG. 3. The connector holder 40 as a holding member, is engaged with links 21 (link I and link II) through shafts 20 (shaft I and shaft II), and also movable to the left as viewed in FIG. 4 in accordance with the rotational movement (in clockwise or counter-clockwise direction) of an operating lever 7 engaged with the links 21, and is moved to the right to release pressing and enable the interchange of the cartridges, and on the other hand, is moved to the left to thereby receive the cartridges loaded.

If the operating lever 7 is pivoted clockwise about a shaft 9, the holder 40 will come forward and the pins 10 will be engaged with the cartridges C, which will thus be loaded onto the loading position. The tip ends 10*b* of the push pins 10 respectively bear against the dash surfaces 1*d*, of the four cartridges C, and press the cartridges. Also, the outer peripheral surfaces 10*c* of the push pins 10 are designed to bear against the dash surface 2S of the carriage 2 and independently receive thrust forces created in a direction perpendicular to the axes of the pins. Accordingly, the holding member 40 receives only the reaction forces of the springs 10*a* (springs A–D) and is not acted on by the thrust forces. Therefore, even when a plurality of cartridges are to be released at a time, a release lever 7 may be operated by a small operating force to thereby make the mounting and dismounting operations possible.

The following is a description of a mechanism or an operation for the fitting and separation of the head connector 85 of the cartridge C side with respect to a connector 6 (body connector) provided on the body side for engagement with the head connector.

When the body connector 6 is inserted into the head connector 85, if the lever 7 is operated, the body connector 6 and a connector holder 40 will move as a unit. An engagement shaft integral with the body connector 6 is fitted to the slit-shaped engagement hold fitting portion of the connector holder 40 by the resilient force of a tension spring 41 (see FIG. 4). Thereupon, the head connector 85 forms contact with the body connector 6, and is guided by the inclined surface (not shown) of the body connector 6, whereby the body connector 6 is fitted (coupled) to the head connector 85. Thereafter, the connector holder 40 moves rightwardly by a predetermined distance l toward a scanning rail 11 (this movement is accomplished by the rotation of the lever 7). This predetermined distance is the distance of movement of the connector holder 40 for bringing the body connector 6 from its positioned state into its movable (liberated) state.

Since the body connector 6 is coupled to the head connector 85 with a force stronger than the force of the tension spring 41, the body connector 6 is liberated from the connector holder 40. That is, the engagement between the two parts is released. Accordingly, during the fitting (coupling) of the body connector 6 to the head connection 85, the body connector 6 is in a separated state relative to the connector holder 40 and thus, the cartridges C are positioned relative to the carriage 2 by only the pressing forces of the push pins 10. Thus the accurate positioning of the recording head 86 relative to the carriage 2 is ensured.

Next, when the cartridges C are to be removed (liberated), the lever 7 is rotated counter-clockwise from its upright position to its horizontal position (the position of FIG. 3). Thereupon, although the engagement shaft is in engagement with the head connector 85 with a strong force, the side of the large-diametered portion of the engagement hole strikes against the engagement shaft as the connector holder 40 moves rightwardly, and said side separates (liberates) the body connector 6 from the head connector while pushing the engagement shaft toward the innermost part as viewed in FIG. 3. At the same time, the push pins 10 also move with the connector holder 40 and thus, become separate from the recording head 86.

(3) Outline of the Recording Apparatus

Figure 5:
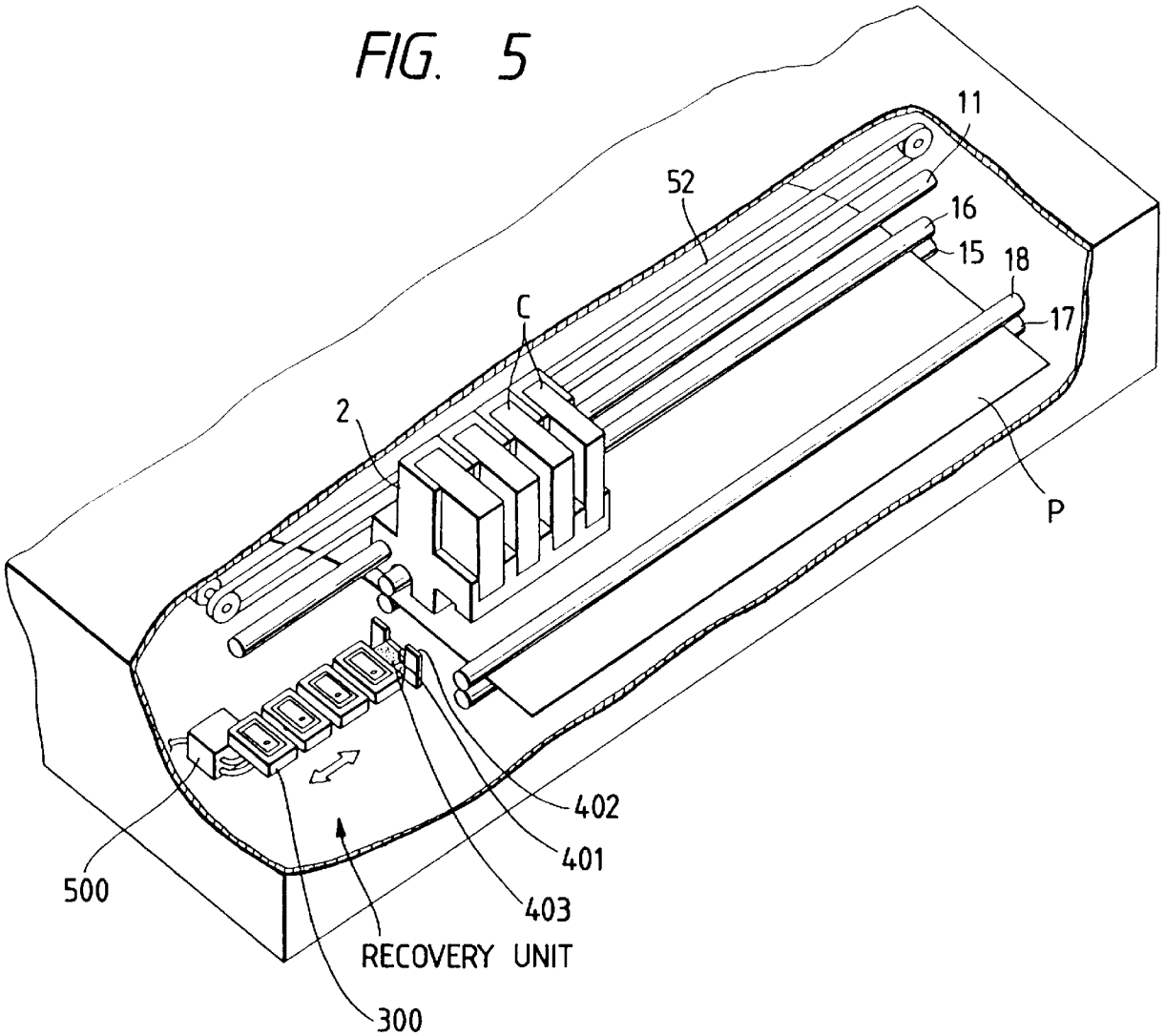
FIG. 5 is a schematic perspective view of the apparatus according to the present embodiment for schematically showing a recovery system unit which is the essential portion of the apparatus.

In FIGS. 3 to 5, the reference numeral 11 designates a scanning rail extending in the main scanning direction of the carriage 2 and supporting the carriage 2, the reference character 11*a* denotes a bearing, the reference numeral designates a flexible cable for providing and receiving various signals to and from cartridges C through a connector, and the reference numeral 52 denotes a belt for transmitting a driving force for reciprocally moving the carriage 2. The reference numerals 17, 18 and 15, 16 designate pairs of rollers disposed before and behind the recording position by the recording head 86 to nip and convey a recording medium therebetween, and the reference numeral 50 denotes a platen for regulating the recording surface of the recording medium flat.

FIG. 4 schematically shows a recording apparatus such as a printer, a copying apparatus or a facsimile apparatus to which the above-described construction is applied.

The recording apparatus body 1000 has a cover 1101 with an operated side which may be opened and closed. When this cover 1101 is opened about the rotational center axis thereof, the interior of the body is opened. Through this opening, the rotational movement of the aforedescribed lever 7 becomes possible to effectuate the mounting and dismounting of the cartridges C1–C4 with respect to the apparatus body. Lever 7 indicated by a solid line in FIG. 4 shows a position in which the cartridge shown in FIG. 1 is mountable, and in this position, the lever 7 precludes the movement of the cover 1101 to its closed position. The cartridges indicated by broken lines display cartridges being mounted, and the cartridges indicated by solid lines are in predetermined positions wherein they are positioned for recording in the apparatus body. At this time, the discharge port forming surface of the recording head 86 of each cartridge is opposed to the guide surface of the platen 50 parallel to the latter, and the recording head portion protrudes downwardly from the carriage and lies between rollers 16 and 18 for conveying the recording medium. The reference numeral 1102 designates a flexible sheet in an electric wiring portion, and the reference numeral 12 denotes a rail which cooperates with the rail 11 to support and guide the carriage 2.

The connector holder 40 is shown as being in a state in which after the cartridges have been mounted, the lever 7 is moved to a broken-line position and the fixing of the cartridges to the carriage has been completed. The reference numerals 20 and 202 designate shafts on both sides with respect to the direction of movement of the connection holder 40 relative to the carriage. The shafts 20 and 202 are juxtaposed at the same positional levels. These shafts are of a cylindrical shape movable in two elliptical holes with their central major axes on a straight line on both sides of the carriage. In FIG. 4, the shafts 20 and 202 correspond to the lever 7 indicated by a solid line in the positions indicated by solid lines. These shafts 20 and 202 ensure the parallel movement of the connector holder. In the present embodiment, the shafts 20 and 202 are provided outside the connector body and are disposed above and near the push pins 10 for positioning the recording head, and this leads to the improved positional accuracy of the push pins 10 for positioning the recording head. It is also possible to provide shafts similar to the shafts 20 and 202 in the connector body, stabilize the parallel movement of the connector body and provide a degree of freedom in the longitudinal direction and the left to right direction corresponding to the gap thereof with respect to a side plate after the connection of the connector. In the present embodiment, it is preferable that a slot for the shaft 202 be made such that after the connector body is connected, the shaft 202 is not fixed in the longitudinal direction but the positioning of the push pins 10 for positioning the recording head becomes dominant only over the shaft 20.

(4) Outline of the Recovery System Unit

The recovery system unit according to the present embodiment will now be described.

FIG. 5 is a schematic view illustrating the disposition region and construction of the recovery system unit, and in the present embodiment, the recovery system unit is disposed on the home position side.

In the recovery system unit, the reference numeral 300 designates cap units corresponding to a plurality of cartridges C, each having a recording head 86. The can units 300 can be slided in the left to right direction and moved vertically as indicated in FIG. 14 with the movement of the carriage 2. When the carriage 2 is in the home position, the cap units join with the recording heads 86 to cap the latter.

Also, in the recovery system unit, the reference numerals 401 and 402 denote first and second blades as wiping members, and the reference numeral 403 designates a blade cleaner formed (for example, of an absorbing material) to clean the first blade 401. In the present embodiment, the first blade 401 is held by a blade lifting mechanism driven by the movement of the carriage, whereby the first blade 401 can be set to a position in which it is protruded (lifted) to wipe the exposed surface of an orifice plate 103 of the discharge port forming surfaces of the recording heads 86 as well as a retracted (lowered) position so as not to interfere with said exposed surface. In the present embodiment, each recording head 86 is mounted so that the portion thereof having a width b in FIG. 2A lies on the left side as viewed in FIG. 5, and the design provides that the wiping by the first blade 401 is effected when the carriage 2 is moved from left to right as viewed in FIG. 5. Thereby, the exposed surface of the orifice plate 103 is wiped only from a narrow portion (a portion of width a) defined by the location at which the discharge ports shown in FIG. 2A are disposed toward a wide portion (a portion of width b). The second blade 402 is fixed at a position for wiping the discharge port forming surfaces of the recording heads 86 which are not wiped by the first blade, i.e., the surface of the keep member 109 lying on the opposite side portions of the exposed surface of the orifice plate in FIG. 2A.

Further, in the recovery system unit, the reference numeral 500 denotes a pump unit communicating with the cap units 300. The pump unit 500 is used to create negative pressure during the suction process or the like carried out with the cap units 300 joined to the recording heads 86.

(4.1) Cap Unit

Figure 6:
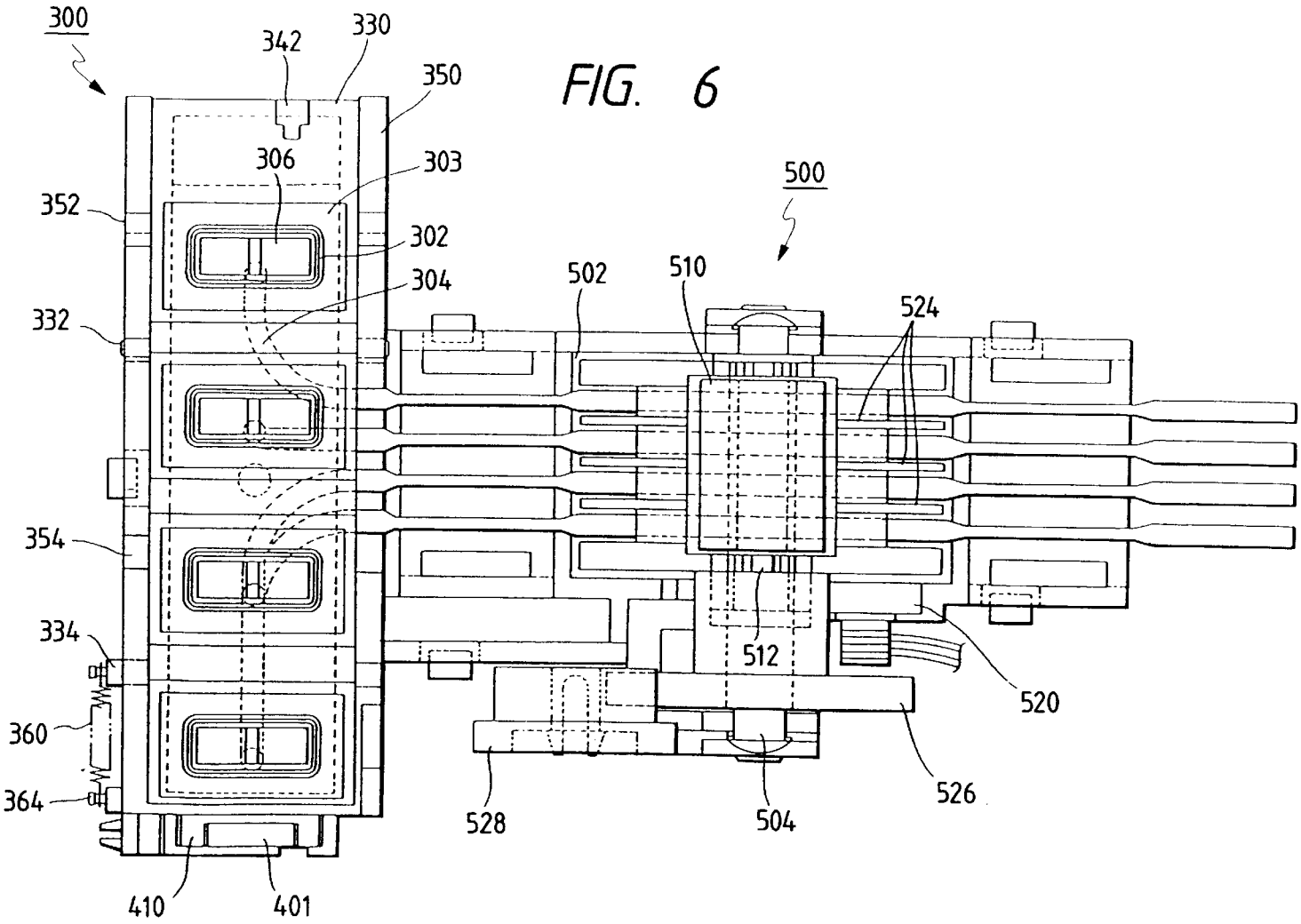
FIGS. 6 and 7 are a plan view and a side view, respectively, showing an example of the detailed construction of the recovery system unit.

FIG. 6 is a plan view showing an example of the detailed construction of the recovery system unit.

First, the cap unit 300 has caps 302 which are in intimate contact with the discharge ports of the recording heads 86, holders 303 supporting the caps, absorbing members 306 for receiving the ink during the idle discharge process and the suction process, suction tubes 304 for sucking the received ink, and a connection tube 305 communicating with the pump unit 500. The number of cap units 300 (in the present embodiment, four) equal to the number of cartridges C, are provided at locations corresponding to the cartridges C and supported by a cap holder 330.

The reference numerals 332 and 336 designate pins projected from the cap holder 330 and engaged with cam slots (not shown) formed in a fixed recovery system base 350 to guide the cap holder 330 in the left to right direction and vertical direction as viewed in FIG. 6.

As shown in FIG. 14, the reference numeral 342 in FIG. 6 denotes an engagement portion rising from the cap holder 330 and engaged with the carriage 2 at a position left of the start position. As the carriage 2 moves to the left of the start position, the cap holder 330 is moved by the engagement portion 342 against the biasing force of a spring 360. At this time, the cap holder 330 is displaced in the left and upward directions. Accordingly, the caps 302 come into intimate contact with the surroundings of the discharge ports of the recording heads 86 to thereby accomplish capping. It is to be noted that the position of the carriage 2 in which this capping is accomplished is the home position.

Figure 8:
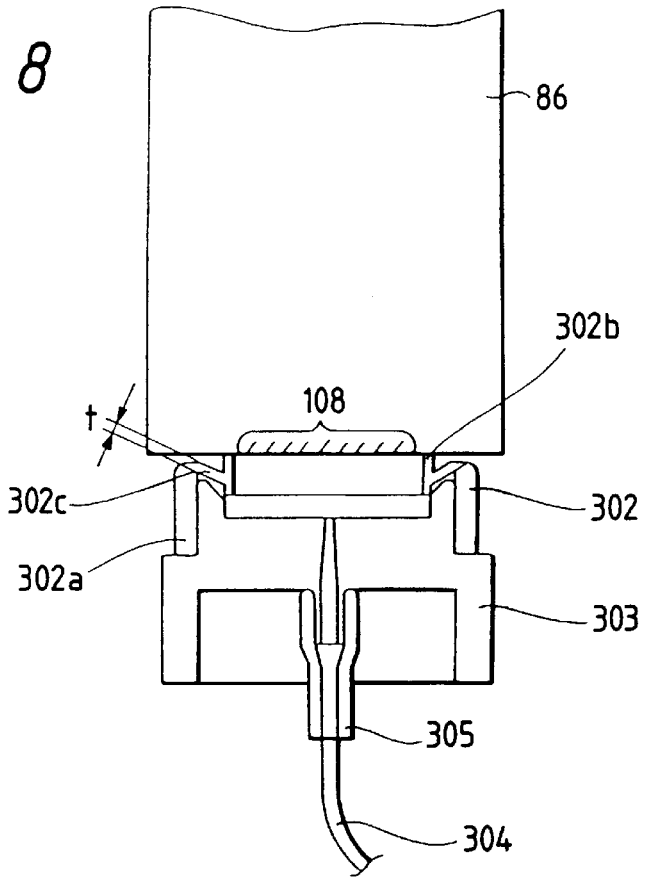
FIG. 8 is a front view illustrating the detailed construction and operation of a copy unit disposed on the recovery system unit.

Reference is now made to FIG. 8 to describe the construction and operation of the cap unit 300 according to the present embodiment. In FIG. 8, the absorbing members 306 are omitted.

The cap 302 is formed of an elastic material, and comprises a fixed portion 302*a* joined to the holder 303, and an edge portion 302*c* for stretching a tubular structure 302*b* over the fixed portion 302*a*, the portions 302*a* and 302*c* being molded as a unit.

The cap 302 can be formed of an elastic material such as silicone rubber or butyl rubber.

By making the thickness of a portion t (edge portion 302*c*) shown in FIG. 8 as small as possible, the follow-up property of the cap 302 relative to the discharge port forming surface of the recording head can be improved. The thickness t of the edge portion 302*c* may preferably be greater than 0.4 mm and less than 1.0 mm.

By virtue of such structure, the tubular structure 302*b* of the cap 302 has elasticity in the direction in which the discharge port sealing means bears against the discharge port forming surface, and this elasticity is utilized to achieve the equalization of the cap to the discharge port forming surface. The bearing of the cap unit 300 against the discharge port forming surface is accomplished by the movement of the cap holder 330 relative to the recovery system base 350. If at this time, the rear end side of the connection tube 304 is opened into the atmosphere and said bearing is effected, the interior of the cap will be held at the atmospheric pressure and the ink meniscus in the discharge ports will not retract, even if the space in the cap decreases.

When the cap is to be separated, a pump action (negative pressure action) by the restitution of the cap resulting from the separation operation is created because the space in the cap has significantly decreased when the cap 302 is caused to bear against the recording head 86, and accordingly becomes easier to retain the ink in the cap. This is because the shrunken cap is restored to its original state when the cap separates from the recording head. Furthermore, when the cap separates from the recording head, the interior of the cap changes from negative pressure condition to atmospheric pressure condition and therefore, the ink is prevented from overflowing from within the cap and the ink can be continuously retained in the cap. This action can be obtained more effectively by setting a space wider than the inner diameter of the cap underneath the holder 303.

(4.2) Blade Lifting Mechanism, etc.

A lifting mechanism for the first blade 401 will not be described.

Referring again to FIG. 7, the reference numeral 410 designates a vertically movable blade holder, on the upper portion of which the first blade 401 is mounted by a mounting means 411. The reference numeral 412 denotes a holder returning spring for biasing the blade holder 410 to its lowered position.

The reference numeral 430 designates a lock lever pivotally movable about a pin 414 projected on the blade holder 410 and engageable with the upper surface portion of a stopper to thereby lock the blade holder 410 in its elevated position. The lock lever 430 is biased upwardly as viewed in FIG. 7 by a spring. Also, in the state shown in FIG. 7, the lock lever 430 is engaged with a portion projected on the blade holder 410 and is held in the position shown.

The reference numeral 440 denotes a release lever pivotally movable about a pin 418 projected from the blade holder 410 to release the locking state of the lock lever 430 in the elevated position of the blade holder 410. The release lever 440 releases said locking by moving pin 418 upward. That is, a pin 442 engageable with the lock lever 430 is studded on the release lever 440, and when the release lever 440 pivots counter-clockwise about the pin 418 as viewed in FIG. 7, the pin 442 pivotally moves the lock lever 430 about the pin 414, thereby releasing the engagement between the lock lever 430 and the upper surface portion of the stopper.

These mechanisms are for elevating the blade holder 410 by a driving force from a cam (not shown) operated with the movement of the carriage 2, and are not of restrictive construction to the present invention.

Figure 9:
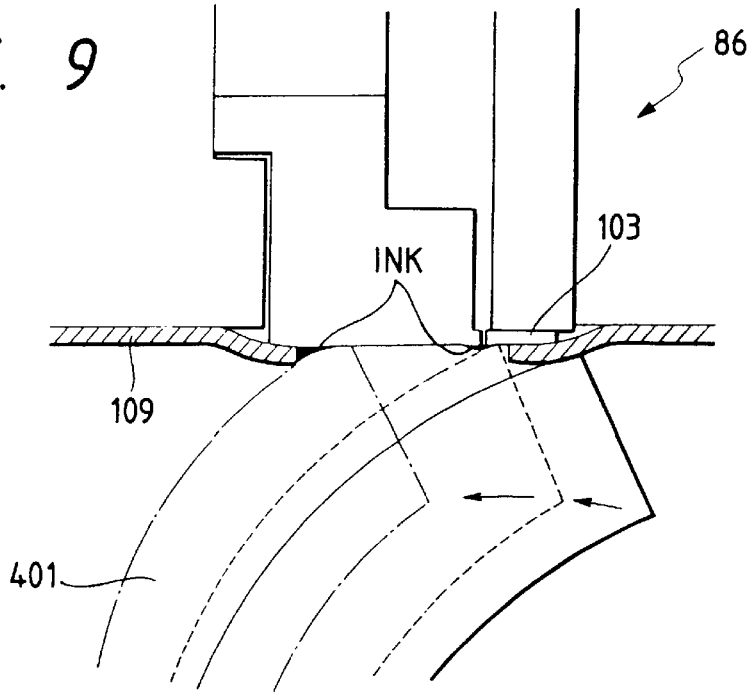
FIG. 9 illustrates the manner of wiping by a blade moved up and down by a blade lifting mechanism.

FIG. 9 is a side cross-sectional view showing the details when the blade 401 effects wiping. As shown in this figure, in the present embodiment, wiping is effected only from the portion in which the width from the discharge ports to the level difference portion is small to the portion in which said width is great. That is, wiping is effected in the direction in which the arrangement of the discharge ports is biased on the orifice plate 103. By doing so, a clean discharge port surface results from wiping and becomes possible to keep a good discharge condition, even if the neighborhood ot the discharge ports is wet or dust or the like, adheres to the discharge port surface.

If conversely, wiping is effected from the portion in which the distance from the discharge ports to the level difference portion is great to the portion in which said distance is small, any ink and dust which could not be removed will collect in the narrower level difference portion with the result that the short distance may cause the orifices to be closed by the remaining ink and dust. This result is not preferable.

Now, in the present embodiment, the first blade is appropriately moved up and down as described above, whereby wiping is effected from the portion in which the distance to the level difference portion is small to the portion in which said distance is large. Even in the worst case, the ink and dust do not appear on the discharge ports 108 and therefore, it becomes possible to maintain a stable discharge condition without affecting the discharge ports.

In the present embodiment, the wiping direction is prescribed as shown in FIG. 9. Therefore, if no consideration is paid to the wiping speed, i.e., the movement speed of the carriage 2, a problem may arise in the follow-up property with respect to the unevenness of the discharge port forming surface, due to various factors (such as modulus of elasticity, etc.) determined by the material, shape, etc. of the blade 401. That is, an inconvenience may occur where that the first blade 401 cannot follow up the level difference portion and when restituted, the first blade has already skipped over the charge ports 108. Therefore, in the present embodiment, these factors are taken into consideration so that during wiping, the carriage 2 may be moved at a lower speed than during the ordinary scanning to thereby ensure the area near the discharge ports will be reliably wiped.

Figure 10A:
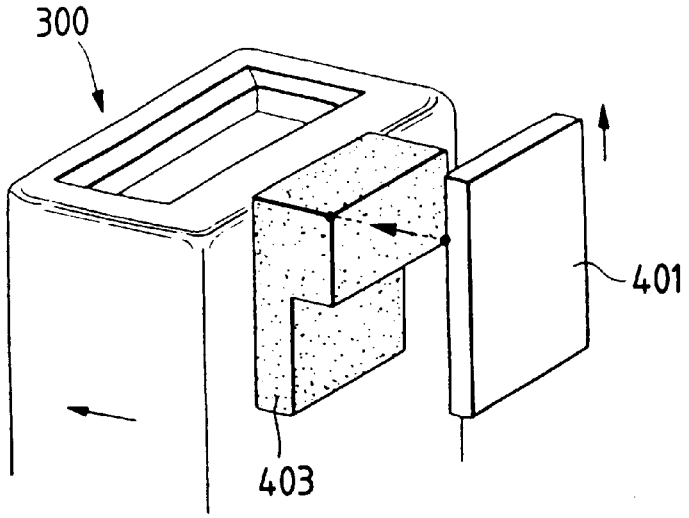
FIGS. 10A and 10B illustrate the manner of cleaning for the blade.
Figure 10B:
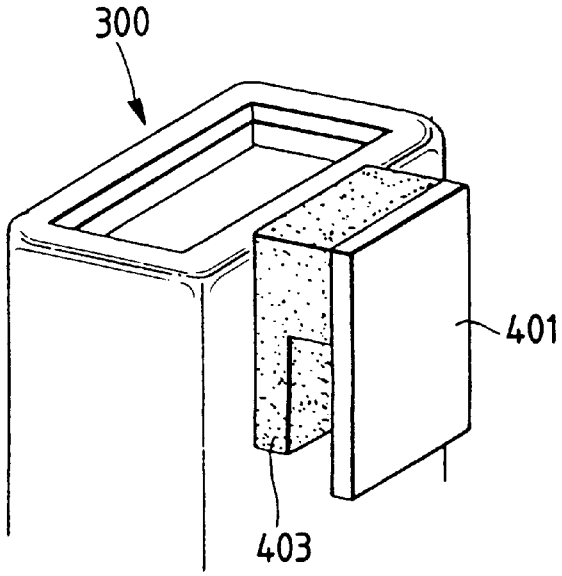

FIGS. 10A and 10B illustrate the manner of cleaning by the blade 401. As described above, with the sliding of the cap unit 300, the blade 401 is elevated, whereafter wiping is effected with the rightward movement of the carriage 2. At this time, in the present embodiment, the ink wiped off and received by the blade 401 flows only along the surface of the blade 401 and does not drip into the apparatus.

As shown in FIGS. 10A and 10B, the blade 401 is lowered when the carriage 2 moves from the right. The blade cleaner 403, even if mounted on the cap unit 300, is in contact with the blade 401 because the cap unit 300 has already returned to its original position. Accordingly, with the lowering of the blade 401, any ink or the like adhering to the surface thereof is received by the cleaner 403 in the form of an absorbing member and thus, is reliably wiped off by the blade 401.

(4.3) Pump Unit

Figure 7:
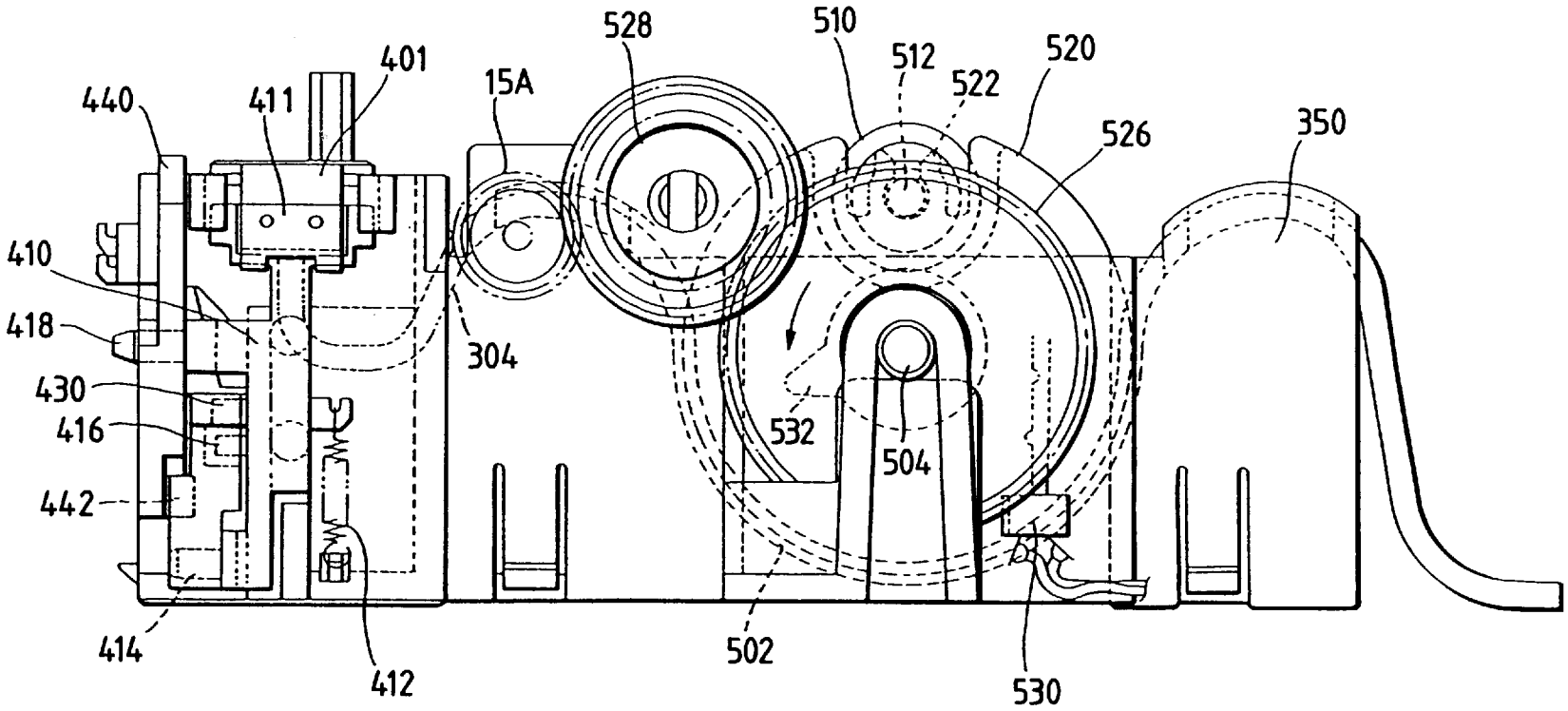

The pump unit 500 will now be described with reference to FIGS. 6 and 7.

The reference numeral 502 designates the regulation surface of the recovery system base provided in the form of a semicylindrical surface. Tubes 304 are constructed as flexible members and creeps on regulation surface 502. The reference numeral 510 denotes a pressing roller which rotates about a pump shaft 504 while urging the tube 304 against the regulation surface 502. The pressing roller 510 rotates while pressing the tubes 304 in the direction of arrow, thereby creating negative pressure in the space heading to the cap unit 300 and effecting ink suction from the discharge ports.

The reference numeral 520 designates a guide roller for rotating the pressing roller 510. The guide roller 520 is supported on the pump shaft 504. The reference numeral 522 denotes a holder for mounting the shaft 512 of the pressing roller 510 on the guide roller 520. The reference numeral 524 designates a partition wall as a guide provided integrally with the guide roller 520 to suppress the tubes 304 and separate them from one another. The reference numeral 526 denotes a position cam made integral with the guide roller 520 to receive the transmission of a driving force for rotating the guide roller 520. The reference numeral 528 designates a pump driving gear having a gear meshing with a gear 15A provided on the shaft of a recording medium conveying (sub-scanning) roller 15 and a gear provided integrally with a position cam 526. That is, in the present embodiment, the driving force for pump driving (the rotation of the pressing roller) is received from the roller 15.

The reference numeral 530 denotes a leaf switch as detection means provided to recognize the roller position. The leaf switch 530 is switched by a cam 532 rotating about the pump shaft 504 with the guide roller 520.

(5) Sequence of the Recording Apparatus (5.1) Position Setting of the Pressing Roller Description will first be made of the setting of the position of the pressing roller of the pump unit 500 for causing a suction force to act to forcibly discharge the ink from the recording head 86.

Figure 13:
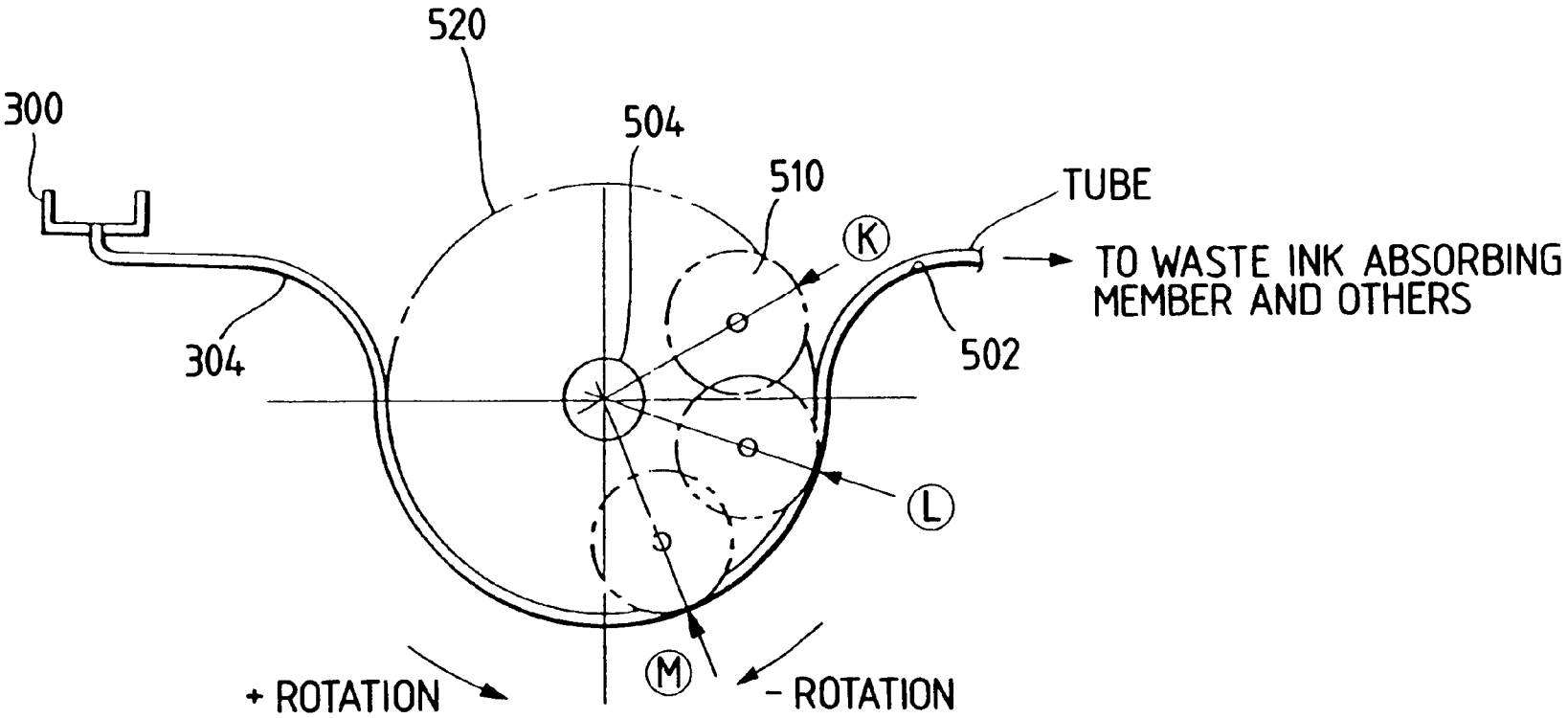
FIG. 13 illustrates the operation of an ink suction mechanism adopted in the present embodiment.

In FIG. 13, which illustrates the pressing roller of pump unit 500, K–M are the set positions of the pressing roller 510. Also, in FIG. 13, the counterclockwise direction (the direction in which suction is effected) is "+" and the clockwise direction is "−".

First, the position K is a state in which the pressing roller 510 is not crushing the tube 304, and in this state, the interior of the cap or the ink suction system is in communication with the atmosphere, even during capping. The positions L and M are positions in which the pressing roller 510 is stopped after it has rotated in the + direction while crushing the tube 304 along the regulation surface 502. In these set positions, the tube 304 is crushed and therefore, during capping, the interior of the cap or the suction system is hermetically sealed with respect to the atmosphere.

In the present embodiment, there are two forms of recovery process by ink suction. One form is effected by the operation of suitable operation means such as a switch or effected automatically as when the ink discharge condition is not satisfactory after a relatively long-period downtime of the apparatus or even by mere idle discharge, wiping or other recovery process. At such time, the ink is difficult to be discharged due to an increase in viscosity or other cause, and therefore, a great suction force is made to act on the discharge ports in the cap. That is, the flow speed of the ink is increased, thereby suddenly discharging the ink. Simultaneously therewith, an idle discharge operation is executed (this is called great recovery or recovery using period).

The other form is effected to better the discharge condition by refreshing or cooling immediately after a predetermined amount of recording operation. Particularly in an apparatus like the present embodiment, which uses heat energy as discharge energy, the temperature of the ink becomes high to some degree and therefore the viscosity of the ink is small at this time and the ink is easily discharged. Therefore, a suction force smaller than that during the great recovery is made to act on the ink to effect the discharge of the ink (which will hereinafter be referred to as small recovery).

During the great recovery and the small recovery, in the present embodiment, the pressing roller 510 rotated in the + direction is set at the positions L and M and held there for a predetermined time. The acting suction force and the amount of suction are determined by an increase in the content volume of the ink suction system, i.e., that content volume corresponding to the length from a position in which the pressing roller 510 rotated in the + direction begins to crush the tubes 304 to the stopped position and therefore, when the pressing roller 510 is stopped at the position M, the suction force becomes smaller than when the pressing roller is stopped at the position L. Thus, the ink is sucked out more slowly from the discharge ports during the small recovery than during the great recovery. Accordingly, the state of the ink flow becomes stable and minute bubbles or the like which may be present inside the discharge ports (i.e., such minute bubbles or the like that cannot be removed due to the creation of turbulence or eddy when the suction force is great and the state of the ink flow is not stable) can also be reliably eliminated. Also, at this time, since the amount of ink sucked becomes smaller, ink in excess of the recovery amount is never consumed.

If it is intended to reduce chiefly the amount of ink consumed, the pressing roller can be set at the position L also during the small recovery and the time for which the pressing roller is stopped thereat can be made smaller than during the great recovery. Also, if it is intended to ensure chiefly the removal of minute bubbles or the like, the rotational speed of the pressing roller 510 may be decreased during the small recovery so that ink suction may be effected slowly. Further, in this case, if the stopped position is determined appropriately, a reduction in the amount of ink consumed can also be achieved.

As the means for forcibly discharging the ink, use may be made of other form of suction pump or means for effecting forced discharge by pressing the ink supply system leading to the discharge ports, but the use of the pump unit 500 as in the present embodiment will make the above-described control or regulation easy to accomplish.

(5.2) Position Setting of the Carriage

The position setting mode of the carriage 2 will now be described with reference to FIG. 14. In FIGS. 14, A–D are positions when the head positioned most adjacent to the recording area is the reference.

Figure 14A:
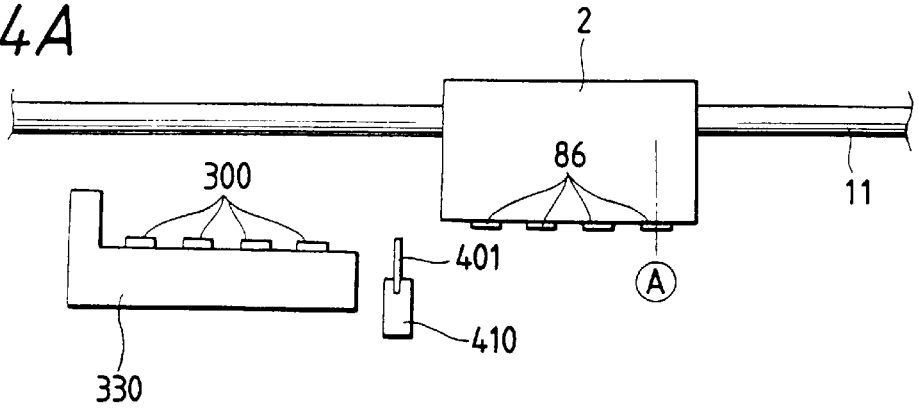
FIGS. 14A–14D illustrate the carriage position during the recovery process in the present embodiment.

FIG. 14A shows the reversing position during wiping. Further, in the present embodiment, this position is defined as a position set when capping is effected or when the blade 401 is elevated. In the present embodiment, the operation for capping or the operation for protruding the blade is performed with the movement of the carriage 2 and therefore, it is necessary that a force greater than a certain degree be transmitted from the carriage 2. So, if the carriage 2 is set at the appropriate position A and is moved from this position to thereby utilize the inertia thereof, a driving force sufficient to drive the above-described mechanism will be obtained without bringing about the bulkiness of a motor which is the drive source of the carriage 2 and an increase in the driving electric power.

Figure 14B:
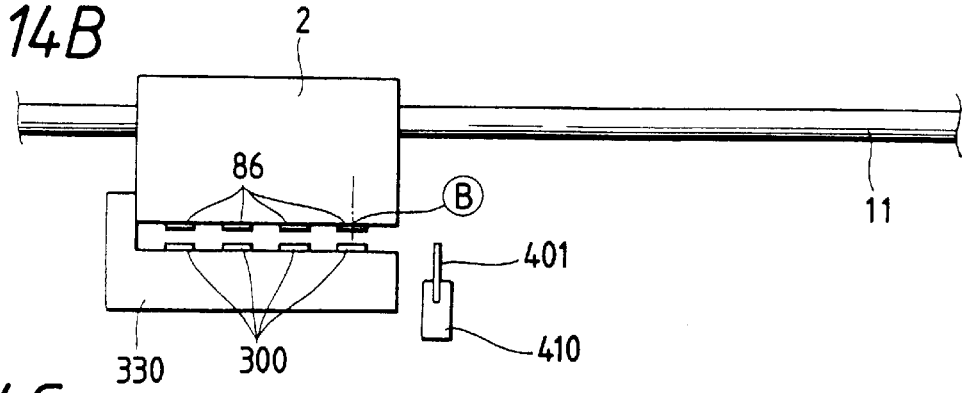

Next, the position B in FIG. 14B shows the start position which is the start position of the recording operation and the reversing position during the recording operation. At this time, the respective heads 86 become opposed to the respective caps 300, but the cap holder 330 and the blade holder 410 are not yet driven and accordingly, the caps 300 are separate from the heads 86 and the blade 401 is not yet elevated. Idle discharge is effected in this position.

Figure 14C:
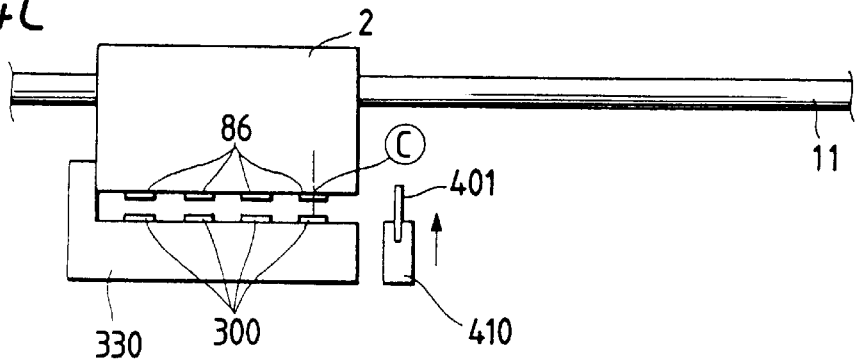
Figure 14D:
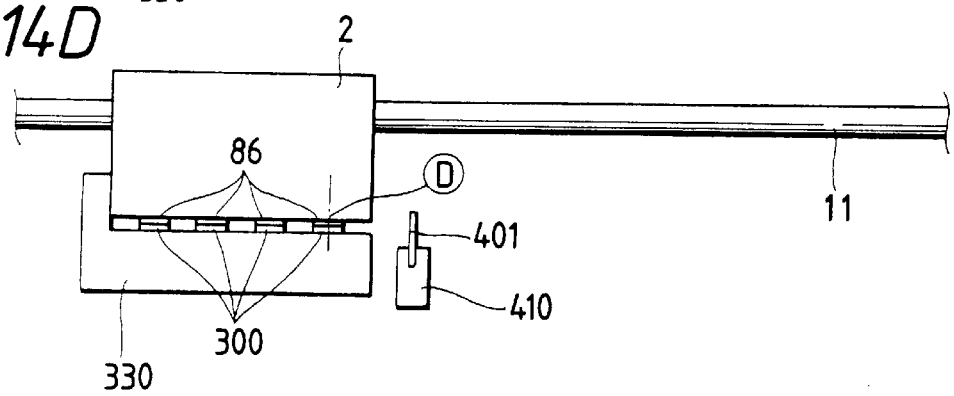

The position C indicated in FIG. 14C is a position at which the upward movement of the blade holder 410 is started. The blade holder passes this position or is set at this position when capping is effected or when wiping is effected. The position D in FIG. 14D is a position at which capping is effected with the cap holder 330 elevated, and in this position, the great recovery or the small recovery is effected or the standby during the downtime of recording is effected.

(5.3) Summary of the Operation Sequence.

FIGS. 15A–15E show a summary of the operation sequence in the present embodiment. In these figures, "1" is a column showing the position of the pressing roller 5–10, and "2" is a column showing the position of the carriage 2. K–M are the same as the roller positions shown in FIG. 13, and A–D are the same as the carriage positions shown in FIGS. 14A–14D.

Figure 15A:
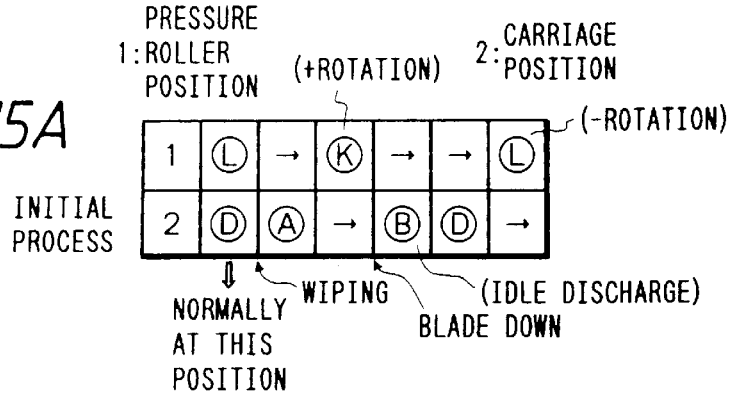
FIGS. 15A–15E illustrate the relation between the operative positions of the ink suction mechanism of FIG. 13 and the carriage of FIG. 14 during the execution of the sequence in the present embodiment.
Figure 15B:
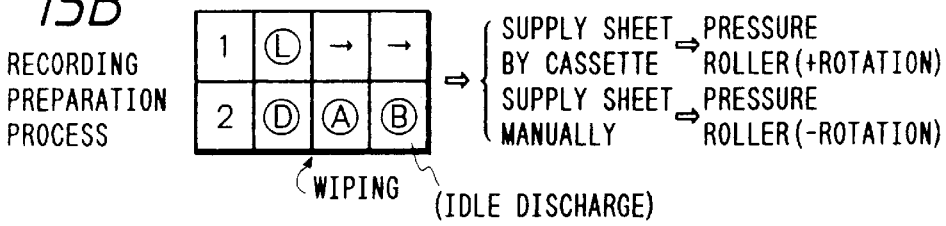
Figure 15C:
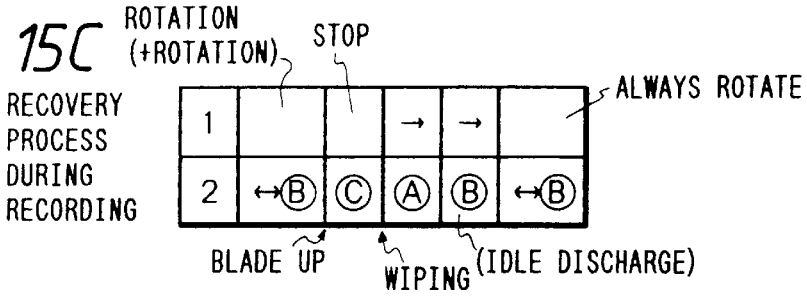
Figure 15D:
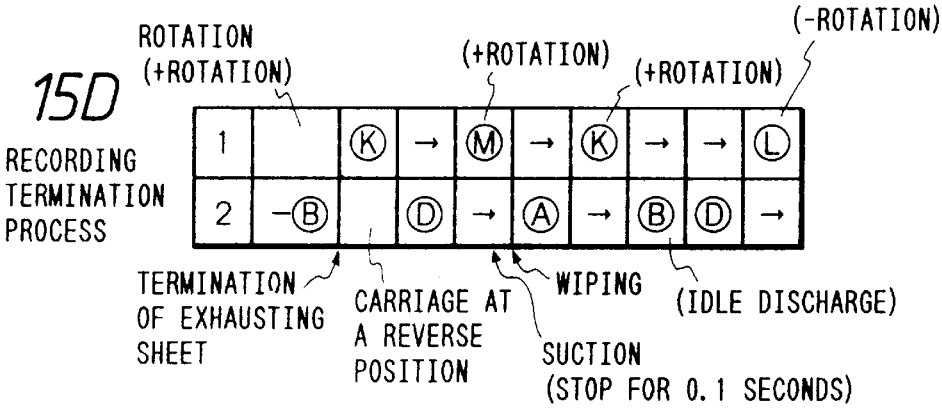
Figure 15E:
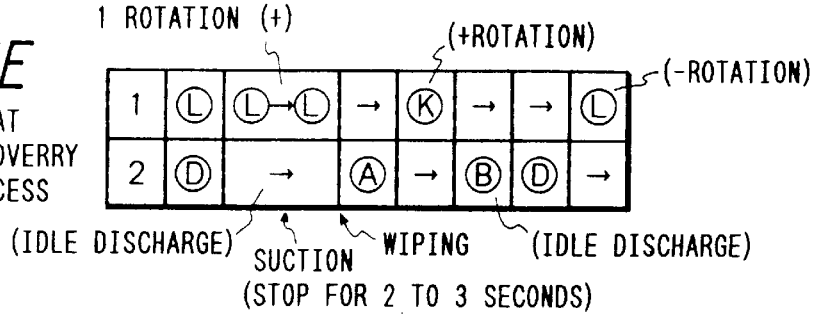

FIG. 15A shows the initial process time after the closing of the power switch, and in this process, the initialization of the positions of the pressing roller and the carriage is effected. FIG. 15B shows the state when a command for the start of recording is given by the depression of a copy button, and thereafter, the feeding of the recording medium by a cassette or by manual supply is effected. FIG. 15C shows the process during wiping or idle discharge effected at suitable timing (for example, each recording scan of 5–10 lines) during the recording process. FIG. 15D shows the recording termination process including the small recovery process carried out immediately after the termination of a predetermined amount of recording (in the present embodiment, recording of one page onto the recording medium). FIG. 15E shows the process during the great recovery.

The details of the above will be described later with reference to FIGS. 17 and 18.

(5.4) Construction of the Control System.

Figure 16:
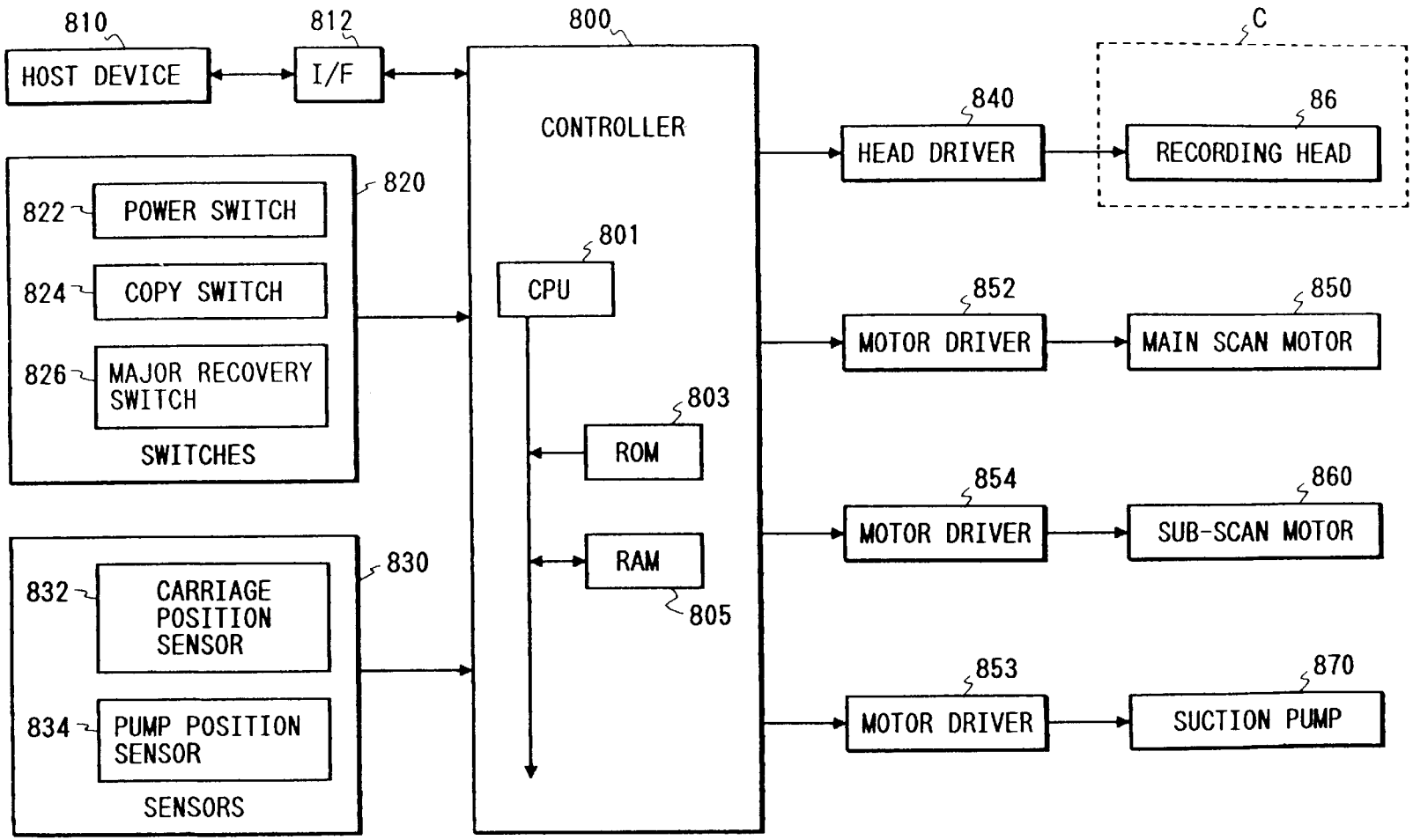
FIG. 16 is a block diagram showing an example of the construction of a control system according to the present embodiment.

FIG. 16 shows an example of the construction of the control system of the present embodiment.

Figure 17:
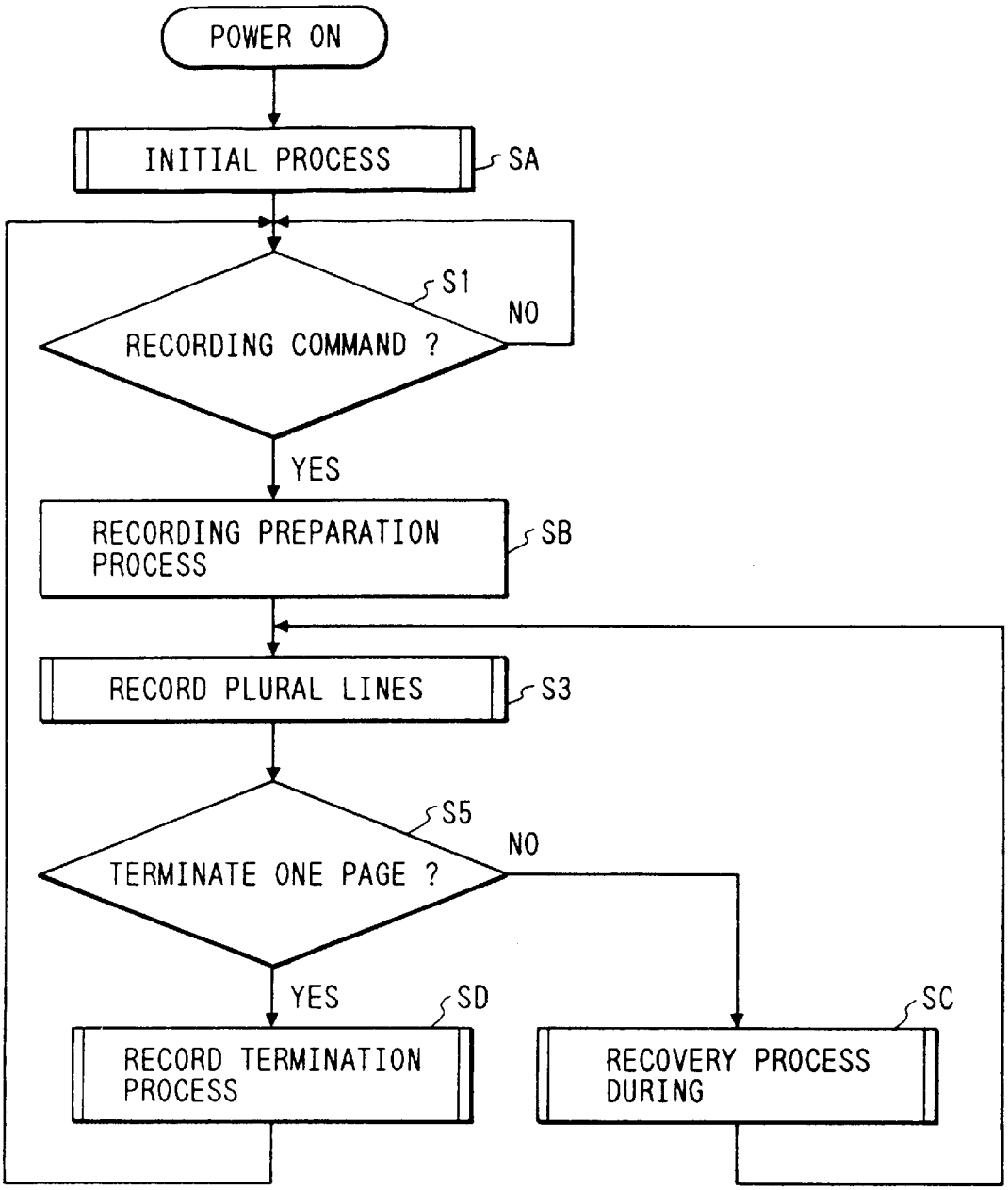
FIG. 17 is a flow chart schematically showing an example of the recording operation procedure by the control system shown in FIG. 16.

In FIG. 16, the reference numeral 800 designates a controller which forms the main control portion and which has a CPU 801 (for example, in the form of a microcomputer for executing the procedure shown in FIGS. 17 and 18), a ROM 803 storing therein a program corresponding to that procedure and other fixed data, and a RAM 805 provided with an area for developing image data and an area for work. The reference numeral 810 denotes a host device which forms a supply source of image data (the host device may be a reader unit, i.e., the means 212 of FIG. 6 or the like). Between this host device and the controller, image data and other command and status signals, etc. are transmitted and received through an interface (I/F) 812.

The reference numeral 820 designates switches for receiving the command input by the operator, including a power switch 822, a copy switch 824 for commanding the start of recording (copying) and a great recovery switch 826 for commanding the start of the great recovery. The reference numeral 830 denotes sensors for detecting the state of the apparatus, such as a sensor 832 for detecting the positions of the carriage 2 such as the home position and the start position, and a sensor 834 including the leaf switch 530, used to detect the position of the pump.

The reference numeral 840 designates a head driver for driving the discharge energy generating elements (in the present embodiment, the electro-thermal conversion members) of the recording heads 86 in conformity with recording data or the like. The reference numeral 850 denotes a main motor for moving the carriage 2 in the main scanning direction (the left to right direction in FIG. 7), and the reference numeral 852 designates a driver for the main motor. The reference numeral 860 denotes a sub-scan motor which is used to convey (sub-scan) the recording medium and in the present embodiment, drives the pressing roller 510 through the roller 15. The reference numeral 854 designates a driver for the sub-scan motor. The reference numeral 870 denotes a suction pump such as the afore-described tube pump, the driving of which is governed by a motor driver 853.

(5.5) Control Procedure.

FIG. 17 is a schematic flow chart of the recording process procedure according to the present embodiment.

When the power switch 822 is closed, the present procedure starts, and at a step 5A, the initial process is carried out. Next, at a step S1, a command signal for the starting of recording, such as a signal for the operation of the copy switch 824, or a command from the host device 810, or a paper feeding signal during the so-called manual paper supply, is waited for. When instructed with the input of image data from the host device 810, a recording preparation process is carried out at a step SB.

Thereafter, at a step S3, the recording of a predetermined number of lines (in the present embodiment, plural lines of 5–10) is effected, and at a step S5, whether the recording of one page has been terminated is determined. If the answer is negative, the recovery process during recording of a step SC is carried out, that is, one recovery process is carried out each time the recording of a predetermined number of lines is terminated, and if the answer is affirmative, a record termination process is carried out at a step SD, whereafter shift is made to the step S1.

Figure 18A:
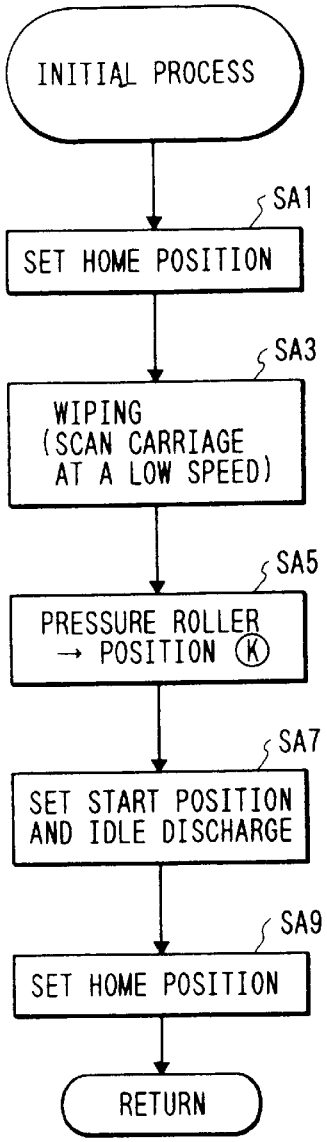
FIGS. 18A–18E are flow charts showing examples of the detailed procedures of the initial process, the recording preparation process, the recovery process during recording, the recording termination process and the great recovery process, respectively, by the control system shown in FIG. 16.

The details of the steps SA–SD and the details of the great recovery process will now be described with reference to FIGS. 18(A)–(D) and (E). The sequences in FIGS. 18(A)–(E) correspond to FIGS. 15A–15E. First, as shown in FIG. 18(A), during the initial process, the setting of the carriage 2 to the home position (the position D) is effected at a step SA1. Also, at this time, the pressing roller 510 is set at the position L (which will hereinafter be also called the roller's home position). In the setting of the carriage 2 to the home position, the movement thereof is utilized to drive the cap holder 330 and the blade holder 510 and therefore, the carriage 2 is set at a suitable position in which the carriage does not overlap with the recovery system unit (for example, the position A in FIG. 16) to obtain an appropriate inertia force so that an approach run may be effected. By the setting of the carriage to the home position, the recording heads 86 are capped and the space in the caps becomes hermetically sealed. Also, at this time, the blade 401 protrudes and has passed the position for being locked (the position C in FIG. 14) and therefore, the blade 401 is in its elevated position (this operation is similar also in the following). If the carriage 2 and the roller 510 are in their respective home positions, the present step may be skipped.

Subsequently, at a step SA3, the carriage 2 is moved toward the position A, whereby the wiping of the discharge port forming surface is effected. This is because the blade 401 has already protruded by the setting of the carriage 2 to the home position. The movement at this time, as previously described, is effected at a speed lower than that during the ordinary recording scan, i.e., a speed at which the blade 401 follows the level difference to effect reliable wiping.

Next, at a step SA5, the pressing roller 510 is rotated to the position K, and at a step SA7, the carriage 2 is set at the start position (the position B in FIG. 14), and idle discharge is effected at this position. That is, idle discharge is effected after wiping. This is similar also in the ensuing process, and in the present embodiment, idle discharge is effected without fail after wiping. With the movement to the start position, the carriage becomes engaged with the release lever, and in order to operate this, the blade 401 is lowered as previously described.

The idle discharge is effected to prevent color mixture or the like which may occur by one blade wiping a plurality of recording heads, and in the present embodiment, in order to accomplish this more effectively, idle discharge is more deliberately effected for the recording heads wiped later or the recording heads corresponding to ink having high brightness of color (such as yellow) because color mixture is readily conspicuous in such recording heads. That is, for those recording heads which are readily susceptible to color mixture, the time for which the idle discharge process is carried out is lengthened or the frequency of discharge is increased.

Also, in the present embodiment, the driving frequency for the electro-thermal conversion members is made lower (e.g., ¼) during idle discharge than during ordinary recording. This is because it has been confirmed that a lower driving frequency results in less wetness of the discharge port forming surface by the ink. Further, in effecting idle discharge, the group of discharge ports is divided into blocks for each predetermined number (e.g. 8) so that the electro-thermal conversion members may be successively driven in each block. It has also been confirmed that this makes it difficult for wetness to occur. Theses modes are similar also in idle discharge effected in the following.

To make it difficult for wetness to occur, the width, voltage, shape, etc. of the driving pulse may be changed instead of or simultaneously with changing the driving frequency, and the manner of driving may be suitably determined.

After such idle discharge, at a step SA9, the carriage 2 and the roller 510 are set at their respective home positions. Here, the carriage 2 is first set at its home position to thereby effect capping, but at this time, at a step SA5, the roller 510 is set at the position K for communication with the atmosphere and therefore, positive pressure does not act in the caps, even by a change in the volume in the caps during capping. Accordingly, air never comes into contact with the discharge ports. Thereafter, the roller 510 is rotated in the – direction in FIG. 13 (if rotated in the + direction, the roller will absorb the ink and this is not preferable from the viewpoint of reducing the amount of ink consumed) and is set at the position L. Thereby the interior of the tubes 304 or the caps becomes somewhat pressurized and the ink received during the previous idle discharge remains without being sucked and the interior of the caps is kept at a wet atmosphere and therefore, it becomes difficult for the evaporation of the ink solvent component from the discharge ports to occur.

Figure 18B:
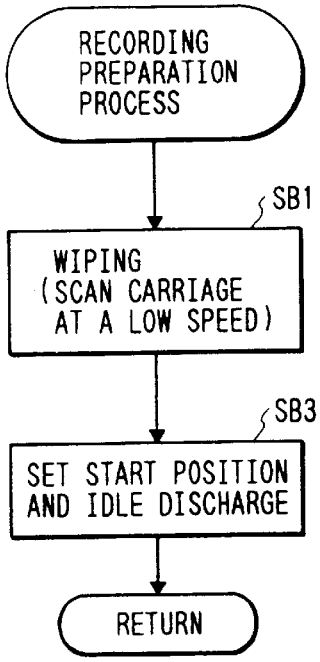

When the starting of recording is commanded (step S1), the preparation process is carried out as shown in FIG. 18(B) before a shift is made to the recording operation (step S3). Here, initially at a step SB1, wiping similar to the step SA3 is effected (the present procedure is carried out after the setting to the home position at a step SA9 and therefore, the blade 401 is already in its elevated position and accordingly, wiping is effected by the movement of the carriage to the position A). Subsequently, in a manner similar to the step SA7, the carriage 2 is set at the start position and idle discharge is effected. The subsequent recording operation is performed always from this position B.

Figure 18C:
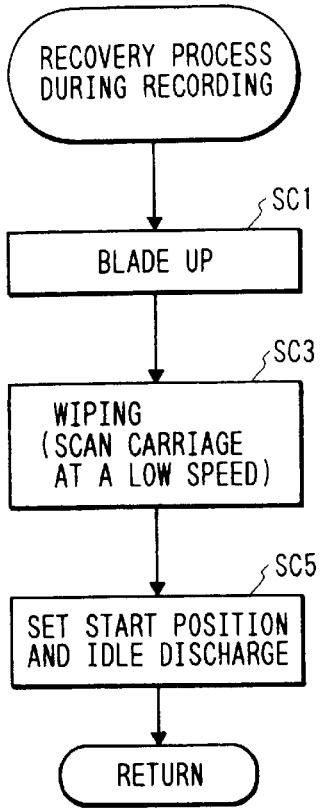

In the recovery process during recording, which is carried out each time a predetermined number of lines are recorded, as shown in FIG. 18(C), at a step SC1, the carriage 2 is first moved to the position C and the blade holder 416 is driven to protrude the blade 401. Thereafter, as at the steps SB1 and SB3, wiping (step SC3) and the setting to the start position and idle discharge (step SC5) are executed. If the present procedure is executed while the conveying process of the recording medium is carried out, the throughput of recording will not be greatly reduced.

Figure 18D:
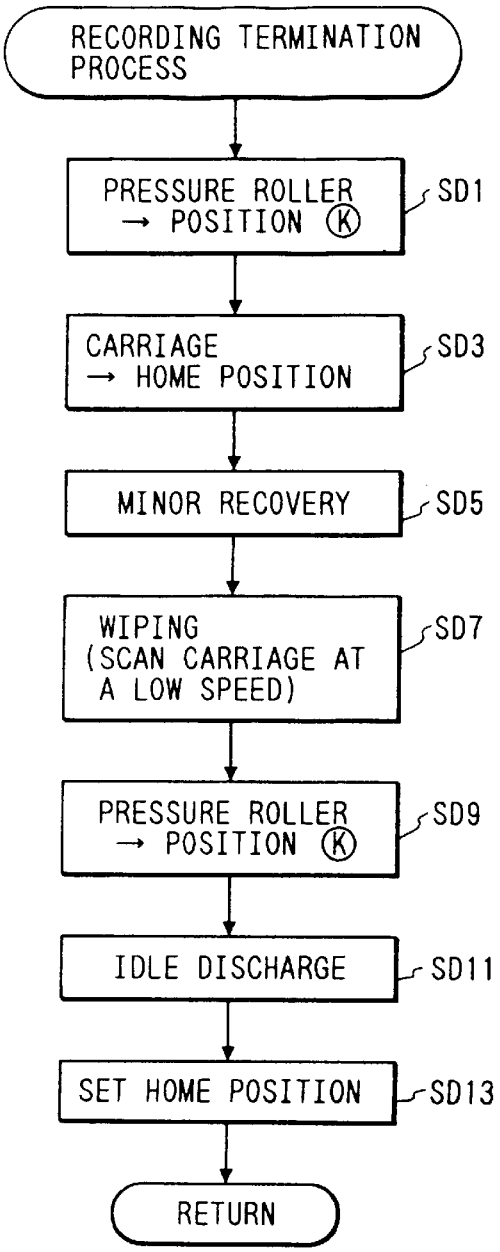

When the recording of one page is terminated and the recording medium for that page is discharged, the pressing roller 510 is subsequently set at the position K as shown in FIG. 18(D) (step SD1). In this state, at a step SD3, the carriage 2 is set at the home position and capping is effected.

Subsequently, at a step SD5, the small recovery operation is performed. Here, the pressing roller is first set at the position M and is held in this position for a predetermined time (e.g. 0.1 second), and ink suction is effected. Thereafter, at steps SD7, SD9, SD11 and SD13, processes similar to the steps SA3, SA5,SA7 and SA9 are carried out, and the apparatus holds the next recording start command with the recording heads being capped.

Figure 18E:
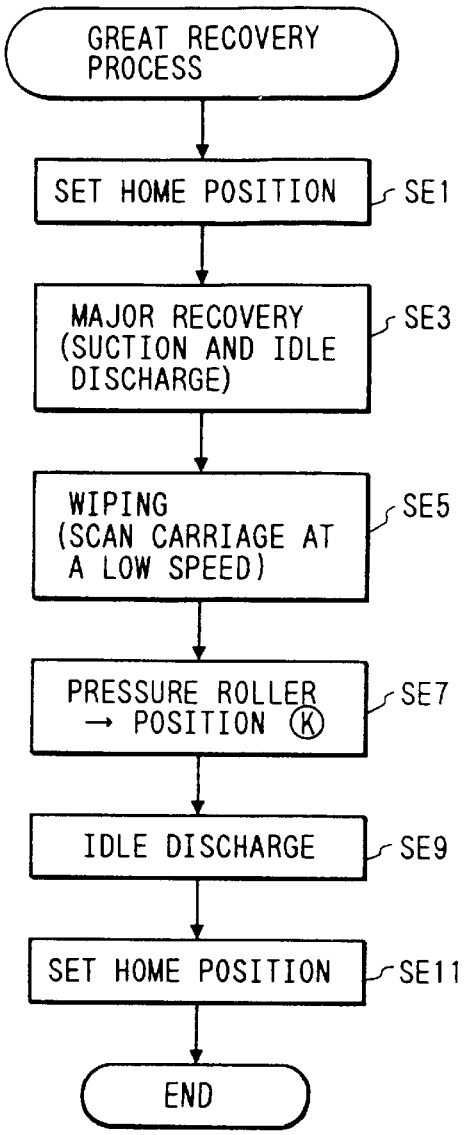

When the great recovery switch 826 is operated, the process shown in FIG. 18(E) is started. In the present procedure, at a step SE1, the setting of the carriage 2 to the home position (the position D) and the setting of the pressing roller 510 to the home position (the position L) are effected, whereafter the great recovery of a step SE3 is effected. Here, the pressing roller 510 is rotated in the + direction and reset at the position L, and is held in this position for a predetermined time (e.g. 2–3 seconds) and ink suction is effected. At the same time, a predetermined idle discharge operation is performed. Thereafter, at steps SE5, SE7, SE9 and SE11, processes similar to the steps SA3, SA5, SA7 and SA9 of FIG. 18(A) are carried out, thus terminating the present procedure. To effect suction and idle discharge at a time, for example, prior to great recovery, predetermined driving data for idle discharge can be set in the driver 840 and this driver can be started at suitable timing.

The purpose and effect of effecting ink suction and idle discharge at a time during the great recovery process as in the present embodiment are as follows.

Figure 19:
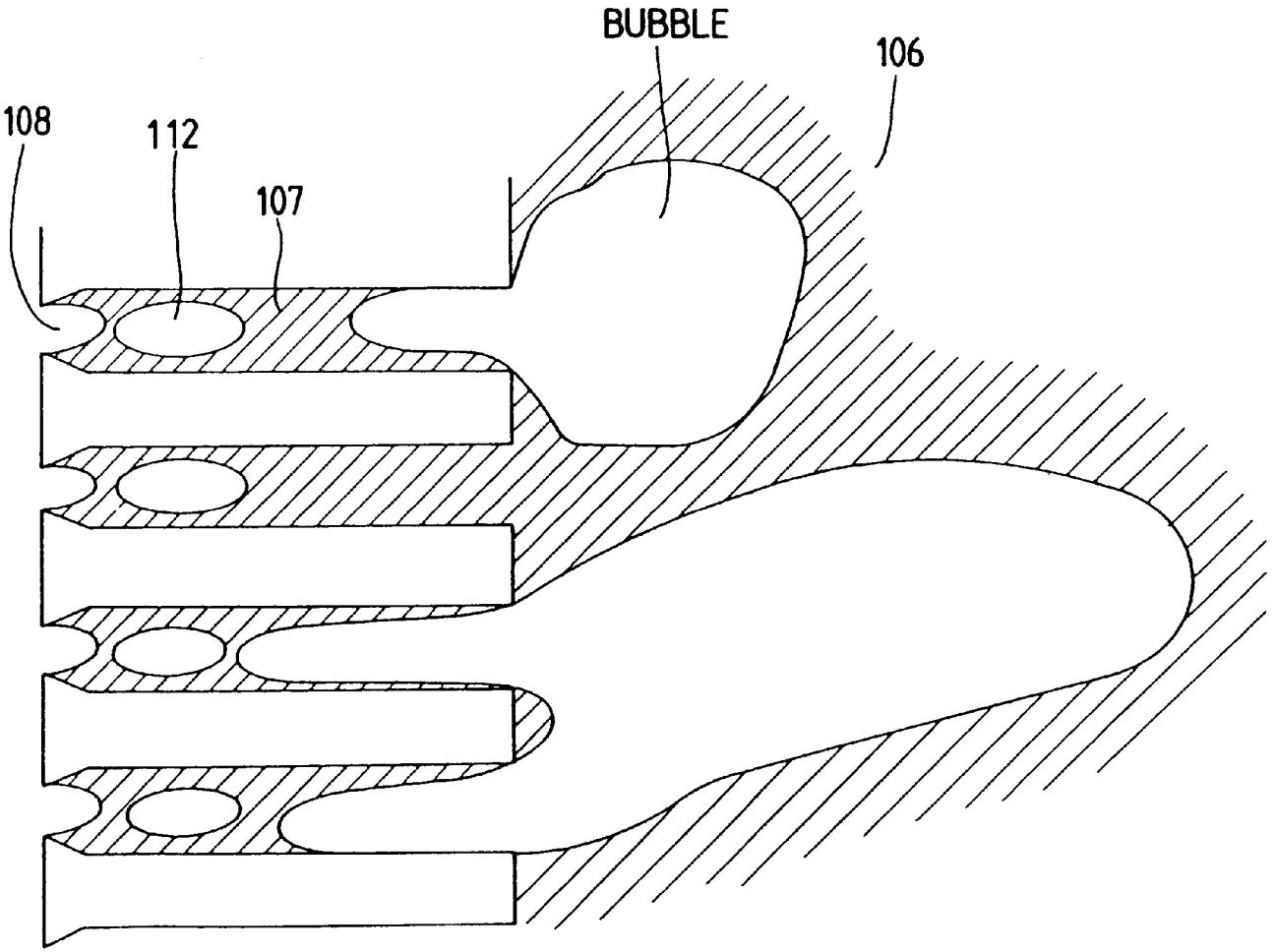
FIG. 19 illustrates the state of a bubble present in a head chip.

FIG. 19 shows a state in which, in the head chips, dissolved gases are deposited in the ink by the apparatus being left as it is or residual bubbles or the like during the discharge gather to form many foams.

When in this state, the discharge energy generating elements such as the electro-thermal conversion elements 112 are driven to perform the discharge operation for recording, the ink is supplied from the liquid chamber 106 into the liquid paths 107 which have effected discharge and therefore, the flowage of the ink takes place in the common liquid chamber 106. As a result, negative pressure is created and therefore, bubbles gather in the liquid paths to hinder the supply of the ink to the liquid paths. Accordingly, discharge becomes unstable and slippage or non-discharge occurs. In an extreme case, bubbles may stick to the rear ends of the liquid paths to completely shut off the supply of the ink into the liquid paths, thus causing non-discharge.

If a number of bubbles are present in this manner, discharge will become unstable and therefore, usually the bubbles are first removed by suction or pressurization. However, where ink of high viscosity is employed or where ink has become high in viscosity under a low temperature environment, bubbles can hardly be removed even if recovery is effected as by suction. The ink will only be wasted.

Figure 20:
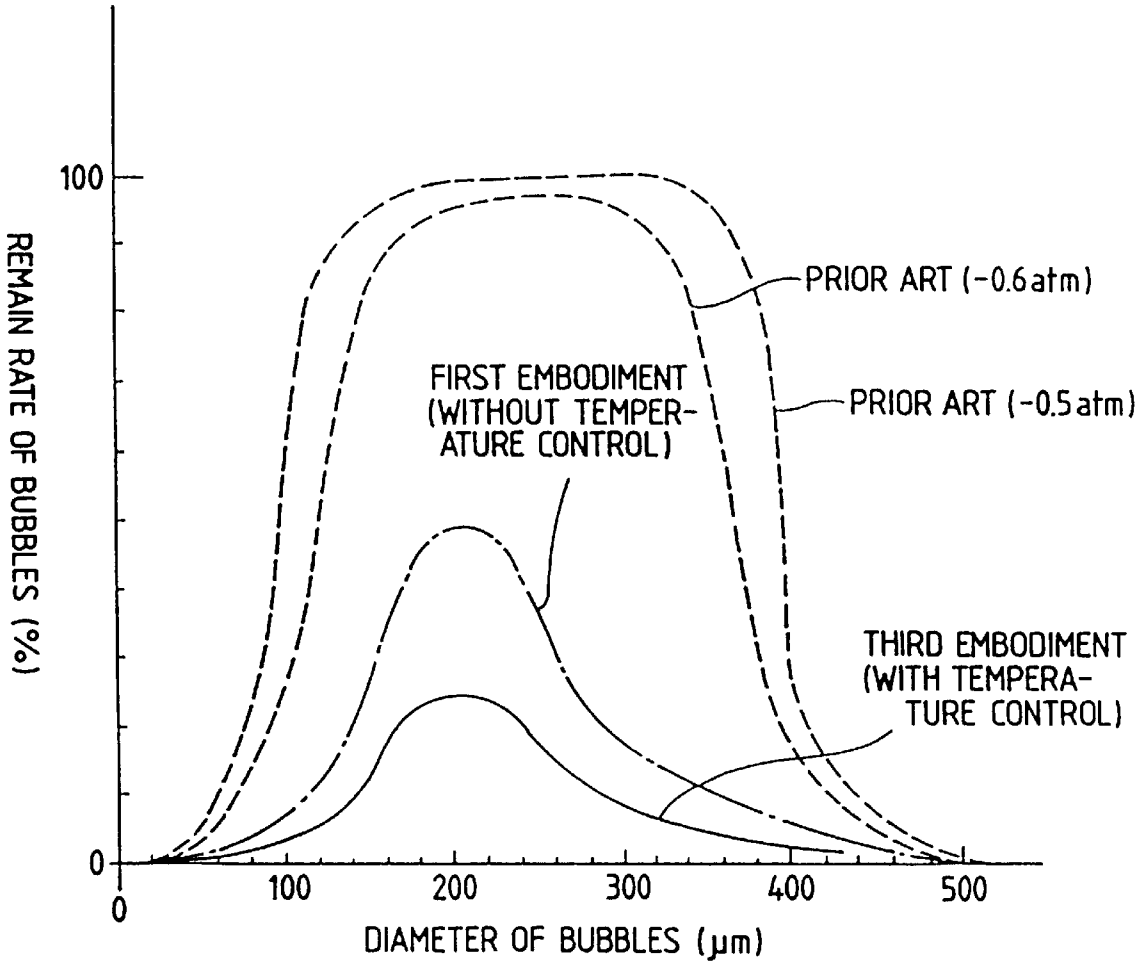
FIG. 20 illustrates the effect of the present embodiment.

FIG. 20 shows the size of bubbles and the rate of bubbles which could not be removed by suction and remained.

The diameter of the liquid paths in the recording head at this time was 40 $\mu$m, and a multinozzle head having sixty-four discharge ports was used. The maximum negative pressure created by the suction pump is −0.5 atm.

It can be seen from this figure that bubbles larger than the diameter of the liquid paths are difficult to remove, but bubbles larger than a certain size are easy to remove. Bubbles smaller than the diameter of the liquid paths can of course be removed, and it is considered that even bubbles larger than the diameter of the liquid paths, if they become larger than a certain degree of size, are deformed and go into the liquid paths, and such bubbles communicate with the atmosphere through the liquid paths, whereby the ink again fills the liquid paths.

As shown, the remain rate of bubbles can be decreased by increasing the negative pressure of the pump (−0.5 atm→−0.6 atm), but a great effect cannot be expected from doing so, and it is not desirable from the viewpoint of making the pump construction compact.

Also, what has been noted above is remarkable when the dye concentration of the ink is increased to realize a high concentration or when the size of the discharge ports are made small to provide high resolution. The fact that the dye concentration is high means that viscosity is high, and with small discharge ports, as compared with large discharge ports, bubbles must be considerably deformed and made smaller than the discharge ports when bubbles of the same ports when bubbles of the same size are to be removed.

In addition, it is difficult to remove bubbles unless a pump is used capable of creating considerable negative pressure during suction, and in some cases, the ink is discharged from only the liquid paths which are not blocked by bubbles during suction, and the flow of the ink in those portions becomes faster and the flow of the ink in the liquid paths blocked by bubbles becomes slower and therefore, negative pressure becomes relatively large in the liquid paths wherein the flow of the ink is fast and thus, bubbles become more difficult to remove.

Therefore, in the present embodiment, during the great recovery of the step SE3, the discharge of the ink is effected simultaneously with suction.

That is, by the ink in the liquid paths being discharged, the negative pressure in the liquid paths after discharge momentarily becomes great, and this, coupled with the negative pressure for suction, creates considerably stronger negative pressure than in the case of a pump singly and moreover, that negative pressure acts equally on each liquid path and thus, the removal of bubbles becomes easy. Further, in the case of the present embodiment, the electro-thermal conversion members 112 as the means for creating bubbles during discharge (the discharge energy generating elements) are driven and therefore, the temperature of the ink in each liquid path rises to reduce the viscosity of the ink and reduce the surface tension of the ink and thus, the flow path resistance power in the liquid paths becomes smaller and the removal of bubbles becomes easier. This is particularly effective because the viscosity increases when the head has been left as it is for a long time.

Figures 21A, 21B, 21C:
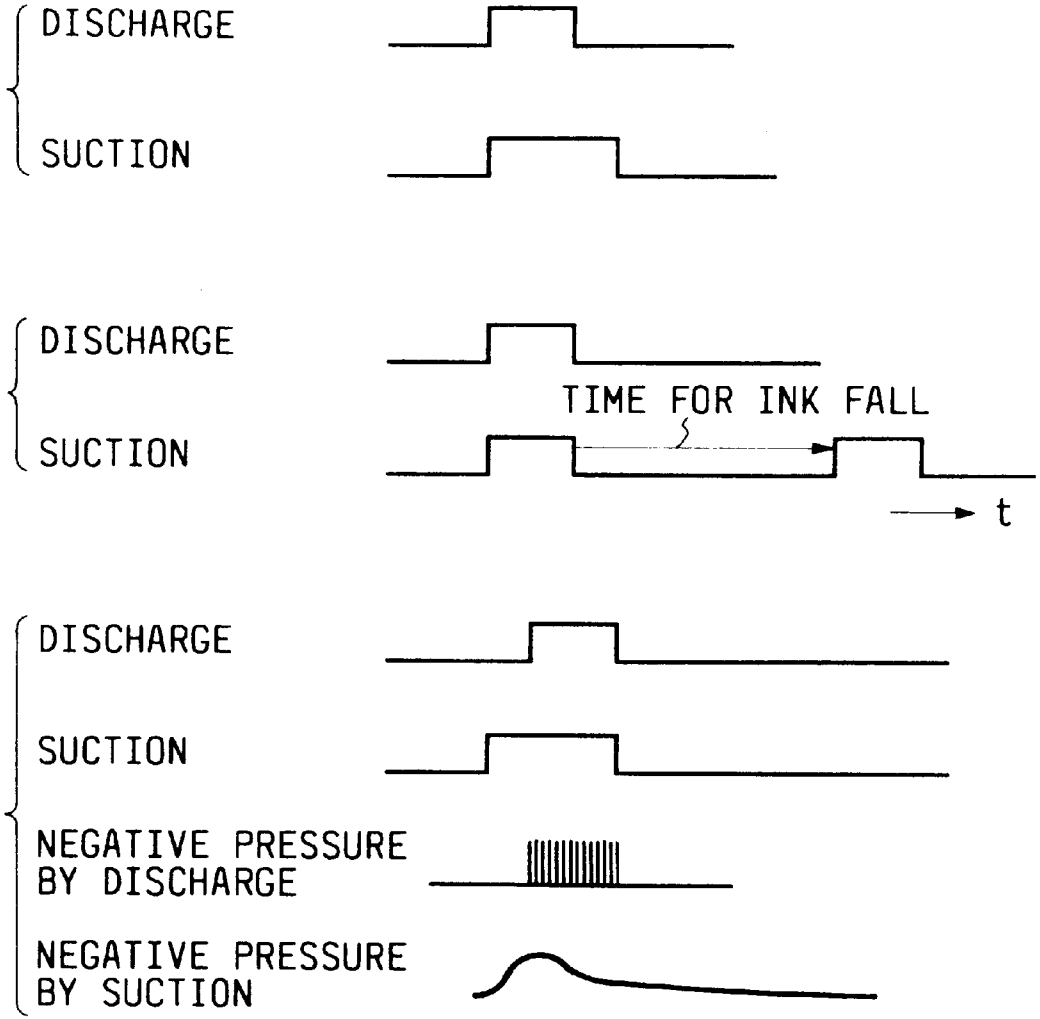
FIGS. 21A, 21B and 21C are timing charts showing the driving condition during the great recovery process in respective embodiments of the present invention.

That is, if as shown in FIG. 21A, the cap is brought into intimate contact with the entire discharge port forming surface and suction is effected by the pump, and at the same, the ink is discharged from the discharge ports, bubbles which have only been drawn near the rear ends of the liquid paths but have not been absorbed outwardly by suction alone will go into the liquid paths and will be discharged outwardly because, by discharge being effected at the same time, flows of ink occur in the liquid paths and the negative pressure in the liquid paths increases.

Thereby, as indicated by a dot-and-dash line in FIG. 20, the bubbles in the inner part of the discharge ports are removed and it becomes possible to accomplish stable discharge.

(6) Other Embodiments

In a second embodiment of the present invention, when discharge is effected simultaneously with suction, use is made of a driving condition exceeding the ink refill frequency which is the limit of the discharge characteristic of the head. By doing so, bubbles in the liquid paths are drawn to the rear by suction and further, these bubbles go into the liquid paths due to the increase in the negative pressure in the liquid paths caused by discharge. On the other hand, in the end portions of the liquid paths, discharge is effected at a frequency greater than the limit of the refill frequency and therefore, the meniscus is vibrating. Assuming that the frequency, in other words, the interval of bubbling, is the time during which the retraction of meniscus is maximum, bubbles forced from the electro-thermal conversion elements (heaters for discharge) and the meniscus will be united and the rear end of the meniscus will become sharp.

Consequently, the bubbles in the liquid chamber which have entered from the rear ends of the liquid paths and the read end portion of the meniscus increased from the fore end will be united.

When this state is created over the entire head, air from the outside into the liquid paths and therefore, a state is brought about in which no ink is present in the liquid chamber (referred to as "ink fall"). The exhaustion of the ink results in the bubbles being absorbed and becoming null.

In the construction of the cartridge C like the present embodiment wherein an absorbing member or the like is placed in the ink tank 80 to thereby render the head into negative pressure relative to the atmosphere, the above-mentioned ink fall is expedited. In such a cartridge, however, only the ink in the inner part of the discharge parts of the head chip become null even if the ink fall occurs, and almost all of the ink corresponding thereto returns into the tank. Consequently, the ink hardly leaves the head and thus, the ink is not wasted.

As shown in FIG. 21B, suction is effected after the ink in the inner part of the discharge ports becomes substantially null. At this time, the suction capacity of the pump is set such that the interior of the head chip is filled with ink and the suction of a further surplus amount can be accomplished.

Thereby, the amount of waste ink required for recovery can be minimized and the running cost of the cartridges, and in turn, the recording apparatus, can be reduced.

In a third embodiment of the present invention, before the process according to the first or second embodiment is carried out, an external heater is driven or a discharge heater is driven so that such a degree of heat that will not cause discharge may be generated therein, thereby raising the temperature of the ink in the liquid paths and reducing the viscosity and surface tension of the ink. Thereby, bubbles are united and readily become large bubbles and further, the fluidity of the ink increases and therefore , the effects of the first and second embodiments are more improved as indicated by a solid line in FIG. 20. Where the present invention is applied to a method of causing ink fall as in the second embodiment, the surface tension of the ink is reduced and therefore the meniscus force at the ends of the liquid paths weakens and further, the refill frequency is reduced by the reduction in the surface tension and thus, it becomes possible to cause ink fall effectively without making the discharge interval smaller than the shortest discharge interval of the body (which corresponds to a case where so-called solid printing is effected).

In a fourth embodiment of the present invention, during suction, liquid paths to be driven are limited to particular ones (for example, the liquid paths on the opposite sides of a plurality of liquid paths are driven and conversely the central area is not driven). That is, if the ink is discharged from all liquid paths, it will become difficult for bubbles to be deformed because each bubble is subjected to a force from the plurality of liquid paths, whereas in the fourth embodiment, negative pressure is made to act concentrated from predetermined liquid paths, whereby the degree of deformation of bubbles can be enhanced.

In a fifth embodiment of the present invention, as shown in FIG. 21C, the start timings of suction and discharge are not made completely simultaneous with each other but are more or less staggered relative to each other. That is, design is made such that the maximum generated pressure during suction and the maximum negative pressure during discharge take place at the same time. This is because the maximum negative pressure during discharge takes place when formed bubbles disappear, and takes place substantially simultaneously with discharge, while the maximum generated pressure by the pump is delayed by a time for which the roller or the like of the pump is moved. That is, it is better that the suction operation is effected more or less earlier than discharge. Thereby, the removal rate of bubbles can be greatly enhanced.

The present invention is not restricted to the above-described embodiments, but of course, any desired modifications can be applied thereto without departing from the spirit of the invention. As such modifications, mention may be made, for example, of the following, in addition to those described herein.

For example, during the small recovery process, if necessary, idle suction may be effected simultaneously with suction. Also, the great recovery process may be suitably divided into two kinds, i.e., a kind in which suction alone is effected and a kind in which suction and idle discharge are used.

Also, the pump for causing a suction force to act may be formed not only in the form using a tube and a roller as described above, but also in a form comprising a cylinder and a piston. Further, the pump may be not only one which sucks the ink from the discharge ports and effects forced discharge, but also one which pressurizes the ink supply system.

Figure 22:
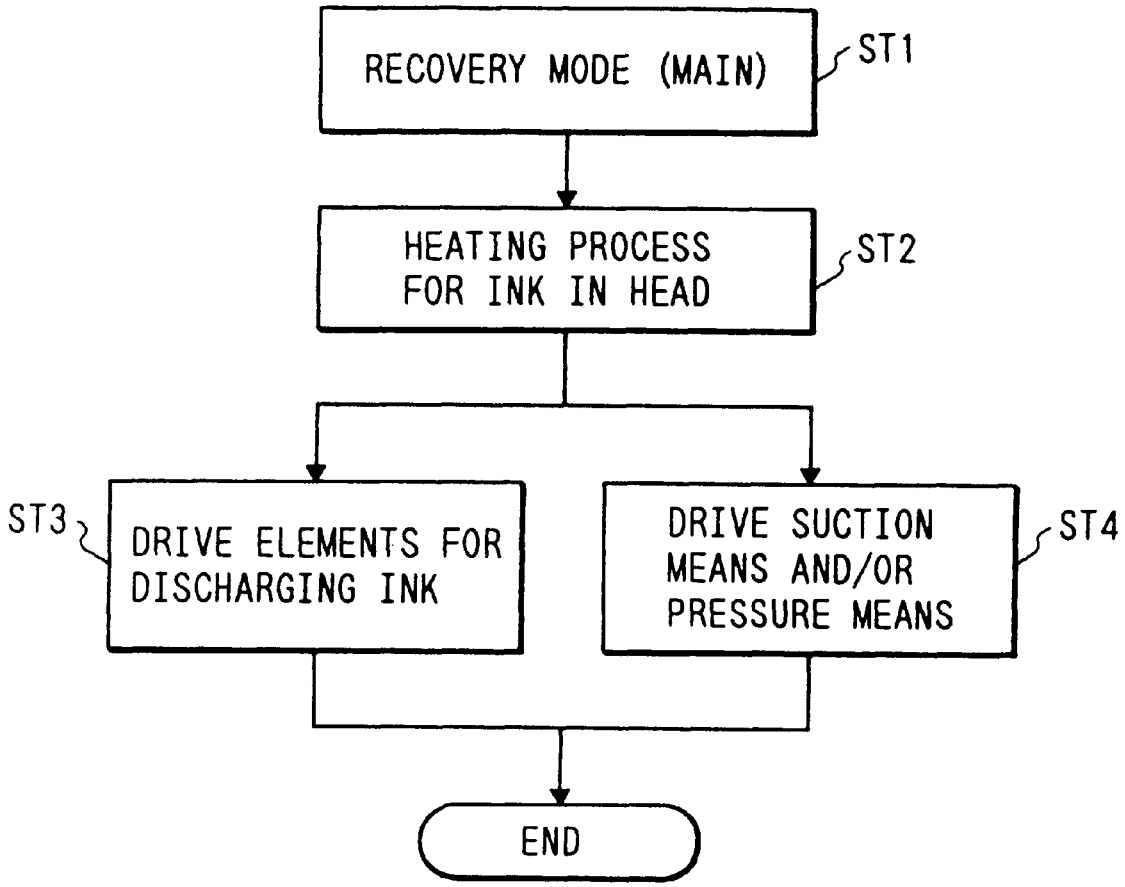
FIG. 22 shows the main flow chart of the present invention.

FIG. 22 illustrates the flow chart of a preferred embodiment of the present invention as a recovery mode, without following the above-described preferred forms of the apparatus construction.

The recovery state of the present invention becomes more preferable if a greater quantity of ink can be uniformly discharged from each discharge port of the head per unit time. In the present embodiment, the recovery mode ST1 is adopted as flow chart or as ordinary main suction recovery by a signal from a selection key.

The heating step ST2 for the ink in the head is carried out in accordance with a recovery mode command. This step ST2 may preferably raise the temperature of the interior of the common liquid chamber, but may also raise the temperature of only the interior of the liquid paths of the head. More preferably, this step may raise the temperatures of both. Well-known means such as an external heater or a heater in the liquid chamber can be adopted for the heating of the common liquid chamber. The heating of the liquid paths can be accomplished simply by supplying an electrical signal so as to effect the aforedescribed preheating if the discharge energy generating elements are heat generating elements for forming bubbles. Where conversely, the discharge energy generating elements are electromechanical conversion elements, heating may be done by using a heater capable of heating each or all of the liquid paths, or light energy or the like. By this step ST2, the inertia force by the fluid resistance between the ink and the inner wall of the head can be decreased and the load during the initial movement can be mitigated.

Subsequently, the driving step ST3 for the elements discharging the ink is carried out substantially simultaneously with the step of driving the suction means (and/or pressure means). This brings about the action of initiating the movement of the ink itself on the spot with the start of the ink suction of the suction means or quickening said start. It has already been described that the uniformity of the ink suction force acting on respective ones of a plurality of liquid paths and discharge ports can be achieved and also tile recovery efficiency can be improved. In the present invention, carrying out the steps ST3 and ST4 substantially at a time includes all that can achieve a generally uniform suction action and an excellent recovery effect as a whole within a relatively short time without making the recovery pump device bulky as in the conventional suction recovery.

In any case, the above-described embodiments reduce the inertia force of the ink and improve the initial ink discharge condition and therefore can solve the problems peculiar to the prior art.

Figure 11:
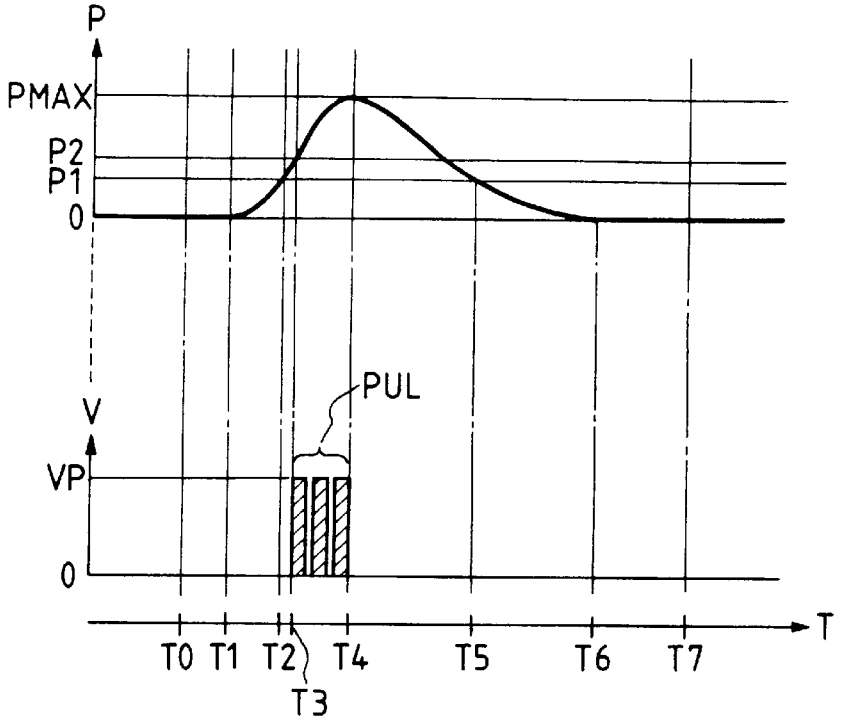
FIGS. 11 and 12 illustrate the recovery using period of the present invention.
Figure 12:
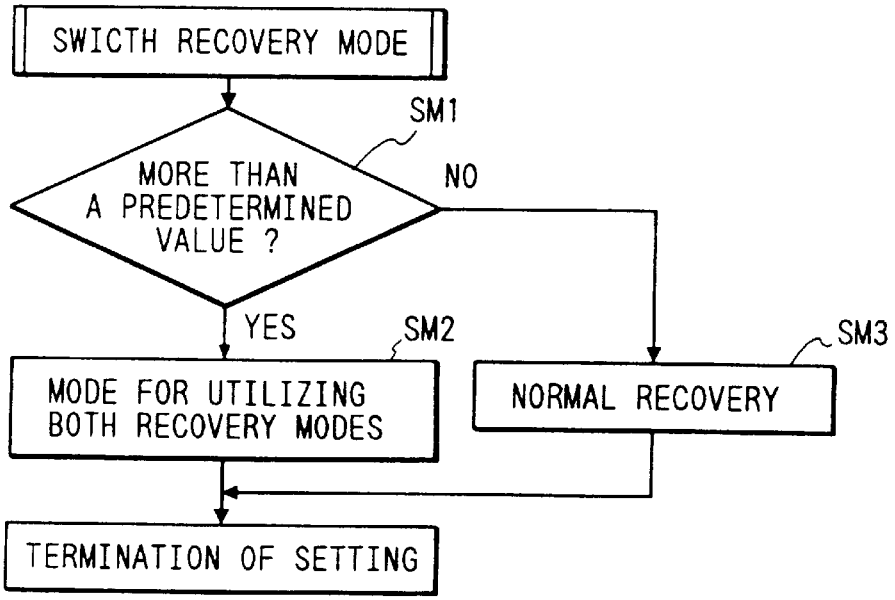

Reference is now made to FIGS. 11 and 12 to describe another example bf the recovery mode of the present invention having a recovery using period during which the driving period for the discharge energy generating elements and the forced discharge period utilizing the suction or pressing pump or the like are used together and executed. A plurality of inventions are covered in the following description.

FIG. 11 is a graph in which the abscissa represents time T and above is shown the pressure P (static pressure) in the ordinate showing the variation in pressure during the forced discharge period and below is shown the pulse voltage V in the ordinate during the element driving period. PMAX is the maximum pressure during the forced discharge period and is produced at a time T4. This can be mentioned, for example, as the maximum pressure produced in one stroke of the pump. P2 indicates a pressure value which is 50% of the maximum pressure PMAX, and P1 indicates a pressure value which is 30% of the maximum pressure PMAX. The times when these pressures P1 and P2 are exhibited are T2 and T3 in succession. The pressures P1 and P2 are produced during the pressure rise and during the pressure fall, and the time when the pressure P1 is produced is a time T5. A time T1 is the time when the pressure is produced, and a time T6 is the time when the pressure disappears. T0 is the time when a start signal for the recovery mode is received.

In the present example, a plurality of pulses PUL of the voltage Vp for recovery are inputted during time T3 to a time T4. The respective pulses are inputted to all discharge energy generating elements of the recording head. In this example, at least one element driving pulse is supplied during the forced ink discharge period from a point in time where the pressure is 50% of the maximum pressure PMAX at static pressure until the pressure becomes the maximum pressure PMAX. Thus, according to the present example, the recovery force during the first half of the pressure rise period is greatly sharpened in its course and therefore, the loss of pressure increment which would otherwise be offset because the initial recovery force overcomes the inertia force of the ink can be prevented. From this point of view, it is preferable to impart the element driving pulses for more than the time T2, i.e., at 30% or more of the maximum pressure PMAX. Regarding the increased pressure, that provided by the formation of bubbles by heat generating elements is more preferable than one provided by piezo-electric elements because the former is sharper.

A further example will be described with reference to FIG. 11. In the above-described example, the element driving pulses PUL are inputted during the increase in the pressure P, but an increase in the recovery force which means an increase in gross pressure can be achieved by imparting the element driving pulses during the fall of the pressure P. From this point of view, it is preferable to impart said pulses until the time T5 when pressure P1 is reached, preferably during the period until the time T6 when the pressure P is present. Discussing now the termination of the forced discharge period and the termination of the element driving period, the pressure P for forced discharge decreases and therefore, in some cases, a small amount of ink which has been brought to the vicinity of the discharge ports by slight pressure may remain on the discharge port forming surface and thus, it is preferable to continue to supply the element driving pulses PUL for a predetermined period after the time T6 when the pressure P disappears, i.e., until the time T7, and further improve the state of each ink path by a sudden discharge force.

Now, in the aforedescribed flow chart of FIG. 18(E), the sequence in which the great recovery, i.e., the recovery mode having the above-described recovery using period, is executed, whereafter the discharge port forming surface is cleaned and thereafter idle discharge is effected is preferable for the following reason. The great recovery is used for both the purpose of eliminating the stay of bubbles in the head and the purpose of discharging any cause of clogging out of the discharge ports. At such time, unnecessary dust and solid matters which have gone out of the discharge ports may remain around the discharge ports. The cleaning step is important to remove these matters effectively, because even if there are minute unnecessary matters which will be returned toward the discharge ports by this cleaning, they can be reliably separated from the discharge port forming surface by the discharge force of idle discharge, without resorting to the great recovery.

Discussion will further provide the time when the forced discharge period is started and the time when the element driving period is started. At the early stage of the recovery process, there is inertia force provided by the intimate contact between the ink and the ink path wall or the ink chamber wall, and the loss of energy is large when the pumping force for forced discharge is resorted to as recovery pressure. As an example which solves this problem, mention may be made of starting the element driving period at the time T1 when the pressure P is produced. This preferably leads to the effective utilization of the pumping force. It is more preferable to effect the element driving also for the time T1 to the time T2. In addition, starting the element driving period during the time T0 when a recovery signal is outputted before time T1 is preferable because the ink flow state of all discharge ports can be formed before the forced discharge. The element driving pulses supplied from such preceding the start of the element driving period until the above-described recovery using period may preferably be constant in period. Further, it will provide a preferred embodiment that in order to obtain a maximum recovery force, the element driving pulses are applied at the time T4 and more specifically, the maximum growth times of bubbles formed by the heat generating elements are made coinciding with each other.

In the present invention, the foregoing description of the constructions according to FIG. 11 covers all examples in which those constructions are combined in any manner.

A special embodiment will now be described with reference to FIG. 12. This embodiment is a special embodiment in which a normal recovery mode and the aforedescribed mode for utilizing both recovery are provided as the recovery mode and the above are switched and executed. That is, where the ink containing portion has an ink absorbing member therein, the negative pressure fluctuation range often is −30 mm Hg to −120 mm Hg. Assuming that the negative pressure is small, e.g. smaller than −50 mm Hg, sufficient recovery is attained by only the normal recovery, the above-described great recovery can be effected within only the range of negative pressure of −50 mm Hg to −120 mm Hg. Also, where the amount of ink used is depended on, when the amount of ink used exceeds a predetermined value, the great recovery may be required. In such a case, it will lead to the loss of ink to effect the great recovery at all times and therefore, it will provide a preferred embodiment to effect the switching as hereinafter described. The flow chart of FIG. 12 shows a subroutine in which, as described above, when a predetermined value as the reference is discriminated by a detection mechanism for integration count or remaining amount detection (SM1), the normal recovery SM3 for idle discharge alone or for suction alone is effected for more than the reference value (which assumes an absolute value in the case of negative pressure) and the above-described mode for utilizing both recovery SM2 is selected for the reference value. As this reference value, mention can be made of |−50| mm Hg previously described, but this is not restrictive. In any case, the system in which the mode for utilizing both recovery is selected as required is covered by the present invention. Also, the present invention has the above-described embodiments as a plurality of execution processes in the mode for utilizing both recovery, and covers any selective use thereof. Above all, the second embodiment is especially preferable and provides for the greatest recovery force.

The present invention displays the effect of a bulky tube pump used to produce great pressure, or a recovery mechanism for a plurality of color heads.

(7) Others

The present invention provides excellent effects particularly in the bubble jet type recording head and recording apparatus proposed by Canon Inc., among the ink jet recording systems, because such system can achieve higher density and higher accuracy of recording.

The typical construction and principle of this system may preferably be approached by the use of the basic principles disclosed, for example, in U.S. Pat. No. 4,723,129 or U.S. Pat. No. 4,740,796. This system is also applicable to both of the so-called on-demand type and the so-called continuous type. In the case of the on-demand type, it is effective because at least one driving signal corresponding to recording information and providing a rapid temperature rise exceeding nucleate boiling is applied to electro-thermal conversion members disposed corresponding to sheets or liquid paths retaining liquid (ink) therein, whereby heat energy is generated in the electro-thermal conversion members to cause film boiling on the heat acting surface of a recording head with the result that a bubble in the liquid (ink) corresponding to one to one to this driving signal can be formed. By the growth and shrinkage of this bubble, the liquid (ink) is discharged through a discharge opening to thereby form at least one droplet. If this driving signal is made into a pulse shape, the growth and shrinkage of the bubble takes place appropriately on the spot and therefore, discharge of the liquid (ink) with excellent responsiveness can be accomplished, and this is more preferable. This pulse-shaped driving signal may suitably be one as described in U.S. Pat. No. 4,463,359 or U.S. Pat. No. 4,345,262. If the conditions described in U.S. Pat. No. 4,313,124 which discloses an invention relating to the temperature rise rate of said heat acting surface are adopted, better recording can be accomplished.

As the construction of the recording head, besides the combined construction of discharge ports, liquid paths and electro-thermal conversion members as disclosed in the above-mentioned patents (the straight liquid flow paths or the right-angled liquid flow paths), the construction using U.S. Pat. No. 4,558,333 and U.S. Pat. No. 4,459,600 discloses a construction in which the heat acting portion is disposed in a crooked area is also covered by the present invention. In addition, the present invention is effective for the construction based on Japanese Laid-Open Patent Application No. 123670/1984 which discloses a construction in which a slit common to a plurality of electro-thermal conversion members provides the discharge portion of the electro-thermal conversion members or Japanese Laid-Open Patent Application No. 138461/1984 which discloses a construction in which an opening for absorbing the pressure wave of heat energy is made to correspond to a discharge portion. This is because even if the recording head is in any form, recording can be accomplished reliably and efficiently.

Further, the present invention can be effectively applied to a full line type recording head having a length corresponding to the maximum width of a recording medium on which a recording apparatus can effect recording. Such recording head may be of a construction in which that length is satisfied by a combination of a plurality of recording heads or a construction as a single recording head formed as a unit.

In addition, the present invention is effective for a case where use is made of a recording head of the serial type as described above which is fixed to an apparatus body, or a recording head of the interchangeable type which is mounted on an apparatus body, whereby the electrical connection thereof to the apparatus body and the supply of ink thereto from the apparatus body become possible.

Also, as regards the kinds or number of recording heads mounted, only one head may be provided, for example, corresponding to ink of single color and besides, a plurality of heads may be provided corresponding to a plurality of kinds of ink differing in recording color or concentration.

Furthermore, the ink jet recording apparatus of the present invention may take the form of an apparatus used as the image output end of an information processing instrument such as a computer, and in addition, the form of a copying apparatus combined with a reader or the like, and further the form of a facsimile apparatus having the signal transmitting and receiving functions.

As described above, according to the present invention, timing drive is carried out so that the forced discharge operation by suction or pressing and the discharge operation by the driving of the discharge energy generating elements may be performed substantially at a time, whereby it becomes possible to simply remove bubbles in the inner part of the discharge parts. Also, it becomes unnecessary that the ability of the forcible recovery means such as a pump for effecting suction or pressing be made great, and this leads to the possibility of making the recording apparatus body compact and low in cost.

What we claim is:

1. A recovery method for recovering proper operation of an ink jet recording head having a plurality of discharge ports and a plurality of thermal energy generating elements each corresponding to each of said discharge ports, the method comprising the steps of:

providing a recovery means for performing recovery according to at least two different recovery modes including a first recovery mode for only applying pressure to said discharge ports to effect suction of ink from said discharge ports while said discharge ports are capped by a capping means and a second recovery mode for concurrently applying pressure to said discharge ports and driving said thermal energy generating elements to forcibly exhaust ink from said discharge ports while said discharge ports are capped by said capping means; and selectively performing one recovery mode of the first recovery mode and the second recovery mode.

2. A recovery method according to claim 1, further comprising the step of heating the ink, wherein said heating step is performed when said recovery is performed according to said second mode and prior to said driving.

3. A method according to claim 2, wherein said driving further comprises supplying said thermal energy generating elements with a driving signal for forming bubbles in the ink.

4. A method according to claim 3, wherein said driving further comprises supplying said heat generating elements with a plurality of said driving signals and forcibly exhausting ink plural times.

5. A method according to claim 2, wherein said pressure is applied by applying suction through said capping means.

6. A method according to claim 2, wherein the heating is performed by driving a heater provided outside of said ink jet recording head.

7. A method according to claim 2, wherein the heating is performed by driving said thermal energy generating elements not enough to discharge ink.

8. A method according to claim 2, further comprising a step of wiping said discharge ports following said step of performing recovery.

9. A method according to claim 8, further comprising a step of discharging ink from said discharge ports following said wiping step.

10. A method according to claims 2, wherein in said driving said thermal energy generating elements corresponding to specific discharge ports of said discharge ports are driven.

11. A method according to claim 2, wherein in said driving a driving frequency of said thermal energy generating elements is lower than during a recording operation.

12. A method according to claim 1, further comprising the step of heating the ink in response to a start of said recovery, wherein said driving is performed after said heating step.

13. A method according to claim 12, wherein said driving further comprises supplying said thermal energy generating elements with a driving signal for forming bubbles in the ink.

14. A method according to claim 13, wherein said driving further comprises supplying said thermal energy generating elements with a plurality of said driving signals and forcibly exhausting ink plural times.

15. A method according to claim 1, further comprising the step of heating the ink before said recovery is performed according to said second mode, and wherein said exhaust takes place during a forcible exhausting period and said driving is performed during an element driving period, wherein said element driving period takes place during said forcible exhausting period while the pressure at said discharge ports is at least 30% of a maximum pressure applied to said discharge ports.

16. A method according to claim 15, wherein during said element driving period each of said thermal energy generating elements is provided with a driving signal for forming a bubble in the ink.

17. A method according to claim 16, wherein said forcible exhausting period comprises a period during which a predetermined suction force is generated by a recovery pump.

18. A method according to claim 17, wherein said suction is applied using said capping means.

19. A method according to claim 15, wherein said ink jet recording head is of a type which can record using the ink supplied from an ink containing member having an ink absorbing member disposed therein.

20. A method according to claim 19, wherein said recovery is performed in a state such that a negative pressure of said ink absorbing member at a static pressure has a predetermined value which is larger than an initial pressure.

21. A method according to claim 15, wherein said element driving period is terminated prior to termination of said forcible exhausting period.

22. A method according to claim 15, wherein said element driving period is started before said forcible exhausting period is started.

23. A method according to claim 22, wherein said element driving period is terminated before said forcible exhausting period is terminated.

24. A recording apparatus for effecting recording with an ink jet recording head having a plurality of discharge ports and a plurality of thermal energy generating elements each corresponding to each of said discharge ports, the apparatus comprising:

capping means for capping said discharge ports;

pressure applying means for applying pressure to said discharge ports to effect suction of ink from said discharge ports while said discharge ports are capped by said capping means; and recovery means for performing recovery according to at least two different recovery modes including a first recovery mode for only applying pressure to said discharge ports to effect suction of ink from said discharge ports while said discharge ports are capped by said capping means and a second recovery mode for concurrently applying pressure to said discharge ports and driving said thermal energy generating elements to forcibly exhaust ink from said discharge ports while said discharge ports are capped by said capping means, wherein one recovery mode of the first recovery mode and the second recovery mode is selected.

25. A recording apparatus according to claim 24, wherein said recording head includes an integral ink containing portion provided with an ink absorbing member therein, and said apparatus further comprises recording means for driving said thermal energy generating elements in conformity with a recording signal to increase a pressure of the ink and discharge the ink from said discharge ports to effect recording on a recording medium;

heating means for heating the ink; and selecting means for selecting between a recording mode wherein only said recording means is operated and a mode wherein said recording means and said recovery means are operated concurrently, wherein the ink is heated prior to a recovery process.

26. A recording apparatus according to claim 25, wherein said thermal energy generating elements are driven with a driving signal for forming a bubble in the ink.

27. A recording apparatus according to claim 25, wherein said pressure applying means starts said suction during growth of a bubble in the ink and exerts a maximum suction force during a collapse of said bubble.

28. A recording apparatus according to claims 25, wherein said pressure applying means further comprises means for causing a suction force to act on the ink during growth of a bubble in the ink.

29. An ink jet recording apparatus according to claim 24, further comprising:

said recording head, wherein said thermal energy generating elements are driven at a driving frequency no greater than a limit frequency that allows the discharged ink to be replaced at said discharge ports; and heating means for heating the ink, wherein in said second recovery mode the driving frequency applied to said thermal energy generating elements is higher than the limit frequency, and the ink is heated prior to a recovery process.

30. An ink jet recording apparatus according to claim 29, wherein said thermal energy generating elements further comprise electro-thermal conversion elements for generating thermal energy for causing film boiling in the ink.

31. A recovery method for recovering proper operation of an ink jet recording head having a plurality of discharge ports and a plurality of energy generating elements each corresponding to each of said discharge ports, the method comprising the steps of:

providing a recovery means for performing recovery according to at least two different recovery modes including a first recovery mode for only applying pressure to said discharge ports to effect suction of ink from said discharge ports while said discharge ports are capped by a capping means and a second recovery mode for concurrently applying pressure to said discharge ports and driving said energy generating elements to forcibly exhaust ink from said discharge ports while said discharge ports are capped by said capping means; and selectively performing one recovery mode of the first recovery mode and the second recovery mode.

32. A recording apparatus for effecting recording with an ink jet recording head having a plurality of discharge ports and a plurality of energy generating elements each corresponding to each of said discharge ports, the apparatus comprising:

capping means for capping said discharge ports;

pressure applying means for applying pressure to said discharge ports to effect suction of ink from said discharge ports while said discharge ports are capped by said capping means; and recovery means for performing recovery according to at least two different recovery modes including a first recovery mode for only applying pressure to said discharge ports to effect suction of ink from said discharge ports while said discharge ports are capped by said capping means and a second recovery mode for concurrently applying pressure to said discharge ports and driving said energy generating elements to forcibly exhaust ink from said discharge ports while said discharge ports are capped by said capping means, wherein one recovery mode of the first recovery mode and the second recovery mode is selected.

* * * * *

UNITED STATES PATENT AND TRADEMARK OFFICE

CERTIFICATE OF CORRECTION

PATENT NO. : 6,145,956
DATED : November 14, 2000
INVENTOR(S) : Koitabashi et al.

It is certified that error appears in the above-identified patent and that said Letters Patent is hereby corrected as shown below:

Drawings,
Figure 12, "SWICTH" should read -- SWITCH --;
Figure 15E, "RECOVERRY" should read -- RECOVERY --.

Column 4,
Line 67, "C" (second occurrence) should be deleted.

Column 9,
Line 66, "not" should read -- now --.

Column 14,
Line 64, "15E. First," should read -- 15E. ¶First, --.

Column 16,
Line 31, "416" should read --410 --.

Column 20,
Line 46, "tile" should read -- the --;
Line 58, "bf" should read -- of --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*